US006736492B2

(12) United States Patent
Yamada et al.

(10) Patent No.: US 6,736,492 B2
(45) Date of Patent: May 18, 2004

(54) APPARATUS FOR EJECTING LIQUID DROPLETS

(75) Inventors: Takahisa Yamada, Hachioji (JP); Takashi Matsuyama, Hachioji (JP); Masanobu Shimizu, Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 70 days.

(21) Appl. No.: 10/013,756

(22) Filed: Dec. 10, 2001

(65) Prior Publication Data

US 2002/0071009 A1 Jun. 13, 2002

(30) Foreign Application Priority Data

Dec. 12, 2000 (JP) ..... 2000-377865

(51) Int. Cl.[7] ..... B41J 2/45
(52) U.S. Cl. ..... 347/71
(58) Field of Search ..... 347/71, 69, 68, 347/40, 72, 49, 20, 54, 42, 47; 310/311, 328, 33; 29/25.35, 890.01, 890.142; 84/730, 743; 366/127

(56) References Cited

U.S. PATENT DOCUMENTS 5,870,118 A * 2/1999 Gunther et al. ..... 347/49
5,959,643 A * 9/1999 Temple et al. ..... 347/40
6,299,295 B1 * 10/2001 Miura et al. ..... 347/68

* cited by examiner

*Primary Examiner*—K. Feggins
(74) *Attorney, Agent, or Firm*—Frishauf, Holtz, Goodman & Chick, P.C.

(57) ABSTRACT

An ink jet head includes four plate-like piezoelectric bodies each having a primary surface having a plurality of parallel grooves formed therein in a predetermined direction, a end surface on which a one end of the groove is open, and an electrode formed on the inner surface of the groove. These piezoelectric bodies are stacked one upon the other on the primary surfaces under the state that the openings of these piezoelectric bodies are allowed to face the same direction, and that the primary surfaces of these piezoelectric bodies are allowed to face the same direction. Further, formed is a common liquid supply path allowing the plural grooves of the piezoelectric bodies to communicate with each other to form ink flow path.

21 Claims, 10 Drawing Sheets

APPARATUS FOR EJECTING LIQUID DROPLETS

CROSS-REFERENCE TO RELATED APPLICATIONS

This application is based upon and claims the benefit of priority from the prior Japanese Patent Application No. 2000-377865, filed Dec. 12, 2000, the entire contents of which are incorporated herein by reference.

BACKGROUND OF THE INVENTION

1. Field of the Invention

The present invention relates to an apparatus for ejecting liquid droplets, particularly, to a share mode type ink jet head.

2. Description of the Related Art

An apparatus for ejecting liquid droplets, e.g., a share mode type apparatus for ejecting liquid droplets, is widely known to the art. The apparatus is widely used as an ink jet head for ejecting an ink droplet.

An example of a conventional share mode type ink jet head (prior art 1) will now be described with reference to FIGS. 1 and 2. FIG. 1 is an exploded perspective view schematically showing an ink jet head as an apparatus of prior art 1. FIG. 2 is a vertical cross sectional view schematically showing the ink jet head shown in FIG. 1.

As shown in the drawings, the ink jet head of prior art 1 includes a rectangular piezoelectric body 10, which is thin and flat. A plurality of parallel grooves 12, which are arranged a predetermined distance P apart from each other in a predetermined arranging direction, are formed on a flat plane 10*a* of the piezoelectric body 10. These grooves 12 are equal to each other in size. Each of grooves 12 has a pair of ends. One end 12*a* of each groove 12 is open at one end surface 10*b* perpendicular to the plane 10*a* so as to form a nozzle-side opening. Also, the other end 12*b* of each groove 12 is formed such that the depth of the groove 12 is gradually decreased from the midway of the groove 12. As a result, the other end 12*b* does not extend to reach the other end surface 10*c* perpendicular to the plane 10*a*.

Electrodes, which are not shown in the drawings for simplicity of the drawings, are formed on inner surfaces, i.e., a side wall and a bottom surface, of each of the plural grooves 12. A conductive pattern 14 is a conductive means formed together with the electrode and electrically connected to the electrode. The conductive pattern 14 is formed to extend in a region between the other end 12*b* of the groove 12 and the other end surface 10*c* on the plane 10*a*.

A terminal flange 16*a* of a liquid supply section 16 is fixed to cover the entire open portion of the plane 10*a* in the region where the plural grooves 12 are open on the plane 10*a*. The terminal flange 16*a* has an ink outlet port 16*c*. The ink outlet port 16*c* communicates with a region in the vicinity of the other end of the opening of each groove 12 on the plane 10*a*. The liquid supply section 16 also includes a small ink container 16*e* equipped with a connection plug 16*d*. A flexible ink supply pipe (not shown) extending from an ink supply source such as an ink tank (not shown) is connected to the connection plug 16*d*. The small ink container 16*e* includes an ink reservoir 16*f* into which the ink from the ink supply pipe flows through the connection plug 16*d*. The ink reservoir 16*f* is fixed to cover the ink outlet port 16*c* on the surface opposite the surface facing the plane 10*a* of the piezoelectric body 10 in the terminal flange 16*a*. An ink filter 16*g* is arranged within the ink reservoir 16*f*.

One end portion of a flexible substrate 18 is fixed to the region to which the plural conductive patterns 14 extend on the plane 10*a*. A plurality of conductive patterns 18*a* is formed on the flexible substrate 18. The conductive patterns 18*a* is electrically connected respectively to the conductive patterns 14 of the piezoelectric body 10. Also, a driving circuit 18*b* is fixed to the flexible substrate 18. The driving circuit 18*b* selectively transmits the voltage supplied from an outer power source (not shown) to the conductive pattern 14 as a driving signal.

A nozzle plate 20 covering the end 12*a* of each of the grooves 12 is fixed to the end surface 10*b* of the piezoelectric body 10. A plurality of nozzles 20*a* is formed in the nozzle plate 20. Each of the nozzles 20*a* is arranged substantially in the center of one end 12*a* of each groove 12. An ink repelling treatment is applied to the outer surface of the nozzle plate 20 on the side opposite the surface facing the end surface 10*b* of the piezoelectric body 10.

First, The ink jet head of prior art 1 pressurizes the ink in the ink supply source, and supplies the ink to the ink reservoir 16*f* through the ink supply pipe and the connection plug 16*d*. The ink thus supplied into the ink reservoir 16*f* flows into all the grooves 12 of the piezoelectric body 10 through the ink filter 16*g* and the ink outlet port 16*c*. It is possible for the ink filling the plural grooves 12 to leak to the outside through the plural nozzles 20*a* of the nozzle plate 20. However, the ink is repelled by the outer surface of the nozzle plate 20 and, thus, is not attached to the outer surface of the nozzle plate 20.

A pressure of the ink within the groove 12 is reduced to negative pressure relative to the atmospheric pressure when the pressurization is released. As a result, the ink forms a meniscus because of the surface tension within each nozzle 20*a*.

While the ink is held under this state, the driving circuit 18*b* selectively impresses a driving signal (driving voltage) to the electrode within the groove 12 in accordance with the control signal generated from a control circuit (not shown), e.g., a control circuit of a personal computer connected to the ink jet printer using a conventional ink jet head. As a result, the side wall of the groove 12 corresponding to the electrode to which the driving signal is impressed is deformed so as to reduce the lateral cross section. When area of the lateral cross section is reduced in the groove 12, the ink in each groove 12 receives a shock wave. A predetermined amount of the ink is ejected outward from the corresponding nozzle 20*a* in the form of ink droplets.

The grooves 12 are formed by applying a rotary cutter blade to the plane 10*a* of the piezoelectric body 10. In each of the grooves 12, the side wall between the adjacent grooves 12 are formed deformable and have sufficient durability. Such being the situation, it is necessary for the side wall between the adjacent grooves 12 to have a reasonable thickness. Because of the particular requirement, the highest groove density achieved nowadays is about 200 grooves/inch (25.4 mm). In general, 180 grooves are formed per inch. In other words, the nozzle density (density of the ejected ink droplets) of the ink jet head using a piezoelectric body thus manufactured is 180 dpi.

The construction of a share mode type ink jet heat of prior art 2 will now be described with reference to FIGS. 3 and 4. FIG. 3 is an exploded perspective view schematically showing the ink jet head of prior art 2, and FIG. 4 is a vertical cross sectional view schematically showing the ink jet head shown in FIG. 3.

The ink jet head of prior art 2 is constructed such that the density of the ejected ink droplets is set at 360 dpi, which is twice the density for the ink jet head of prior art 1.

As shown in FIGS. 3 and 4, the ink jet head of prior art 2 includes two ink jet heads of prior art 1. The two ink jet head is joined to each other such that other surfaces (on the back side of the plane 10*a*) of the piezoelectric bodies 10 stand opposite to each other. It should be noted that, in the ink jet head of prior art 2, the piezoelectric bodies 10 are joined to each other such that a plurality of nozzles side openings (i.e., opening of one end 12*a* of each of the grooves 12) on one end 10*b* of one of the piezoelectric bodies 10 are deviated by half the pitch P, i.e., ½P, from the nozzles side openings of the other piezoelectric body 10 in the arranging direction of the nozzle-side openings, as apparent from FIG. 3.

Also, in the ink jet head of prior art 2, the end surfaces 10*b* of the two piezoelectric bodies 10 are arranged on the same plane, and a common nozzle plate 20' is fixed to the end surfaces 10*b* of the two piezoelectric bodies 10. A plurality of nozzles 20'*a* are made in the nozzle plate 20'. Each of the nozzle 20'*a* is substantially aligned with the center of each nozzle-side opening of the two piezoelectric bodies 10.

As described above, the common nozzle plate 20' is used in the ink jet head of prior art 2. Therefore, if The nozzle-side openings of the two piezoelectric bodies 10 deviate to the predetermined position, the position relations of each nozzles 20'*a* can be set up in each other precisely.

In the ink jet head of prior art 2, a pair of flexible substrates 18 are fixed to a region on the side of the other end surface 10*c* in the plane 10*a*. The planes 10*a* of the two piezoelectric bodies 10 face in the opposite directions to each other. Also, the driving circuits 18*b* are fixed to the flexible substrates 18 such that these driving circuits 18*b* are positioned to face each other. In other words, the driving circuits 18*b* are covered with the flexible substrates 18 so as to be protected from external impact.

However, in the ink jet head of prior art 2, the terminal flange 16*a* and the small ink container 16*e* of the liquid supply section 16 are fixed in a manner to protrude greatly in the opposition direction (in the vertical direction in FIG. 4) from each of the plane 10*a* of the two piezoelectric bodies 10.

In recent years, required is an ink jet printer capable of recording an image smaller in the granular feel at a high speed and with a high resolution. In order to suppress the granular feel, it is necessary to decrease the size of each ink droplet. Where the size of the ink droplet is reduced, it is necessary to increase the nozzle density of the ink jet printer so as to fill a predetermined printing area with ink droplets at a high speed.

In order to increase the nozzle density, it is effective to use two ink jet heads in combination as in the ink jet head of prior art 2. Where the nozzle density is to be further increased in the conventional ink jet printer, it is conceivable to increase the number of ink jet heads of prior art 2. In this case, the weight of the carriage having the ink jet head mounted thereon is increased in such an ink jet printer. Therefore, it is difficult to scan the ink jet head at a high speed. Also, in the ink jet head of prior art 2, it is necessary to align one ink jet head with the other ink jet head accurately in the assembling operation such that the nozzles are aligned with a predetermined accuracy. It follows that the assembling operation is rendered troublesome in the ink jet head of prior art 2.

Also, even if the nozzle density is to be increased by combining a plurality of piezoelectric bodies 10 as in the ink jet head of prior art 2, a difficulty remains unsolved in respect of the arrangement of the liquid supply section 16 and the flexible substrate 18 used as a means for transmitting electric signals. In view of the arrangement of the liquid supply section 16, etc., it is possible to combine at most two piezoelectric bodies, resulting in failure to increase sufficiently the nozzle density of the ink jet head.

An object of the present invention, which has been achieved in view of the situation described above, is to provide An apparatus for ejecting liquid droplets such as an ink jet head, which permits increasing easily the density of the nozzles and also permits the manufacture with a low cost.

Another object of the present invention is to provide an apparatus for ejecting liquid droplets such as an ink jet head, which permits increasing easily the image density and also permits the manufacture with a low cost.

BRIEF SUMMARY OF THE INVENTION

According to an aspect of the present invention, which is intended to achieve the objects described above, there is provided an apparatus for ejecting liquid droplets, comprising:

a plurality of plate-like piezoelectric bodies, each of the piezoelectric bodies including a pair of a primary surfaces, a pair of end surfaces, and electrodes, one primary surface on which a plurality of grooves are formed, the grooves arranged in parallel a predetermined distance apart from each other, each of the grooves having a pair of ends, the one end surface differing from the primary surface, one end of each of the parallel grooves being open in the one end surface, a plurality of nozzles being arranged to conform with the plural openings, the electrode formed on a inner surface of each of the grooves, the primary surfaces of the plural piezoelectric bodies facing the same direction, and the adjacent piezoelectric bodies stacked on the primary surfaces; and a liquid supply path that supplies a liquid to the plural grooves, the liquid supply path being common to the plural piezoelectric bodies;

such that the grooves is supplied with liquid, and a cross section of the grooves is changed to eject the liquid through the nozzles when a voltage is impressed to the electrodes.

As described above, plate-like piezoelectric bodies each having a plurality of parallel grooves formed therein are stacked one upon the other in the present invention. It is theoretically possible to stack an innumerable number of piezoelectric bodies, which are lightweight and compact. Therefore, the apparatus may be provided with a large number of nozzles arranged at a very high density. In addition, a liquid supply path that supplies a liquid to the plural grooves, the liquid supply path being common to the plural piezoelectric bodies. The liquid supply path may supply a sufficiently large amount of a liquid to the plural grooves of the stacked plural piezoelectric bodies through itself. It follows that the construction of the liquid supply sections remains to be simple even if the number of piezoelectric bodies stacked one upon the other is increased.

Various embodiments of the present invention and modifications thereof will now be described with reference to the accompanying drawings.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the present invention, and together with the general description given above and the detailed description of the preferred embodiments given below, serve to explain the principles of the present invention.

DETAILED DESCRIPTION OF THE INVENTION (First Embodiment)

Figure 1:
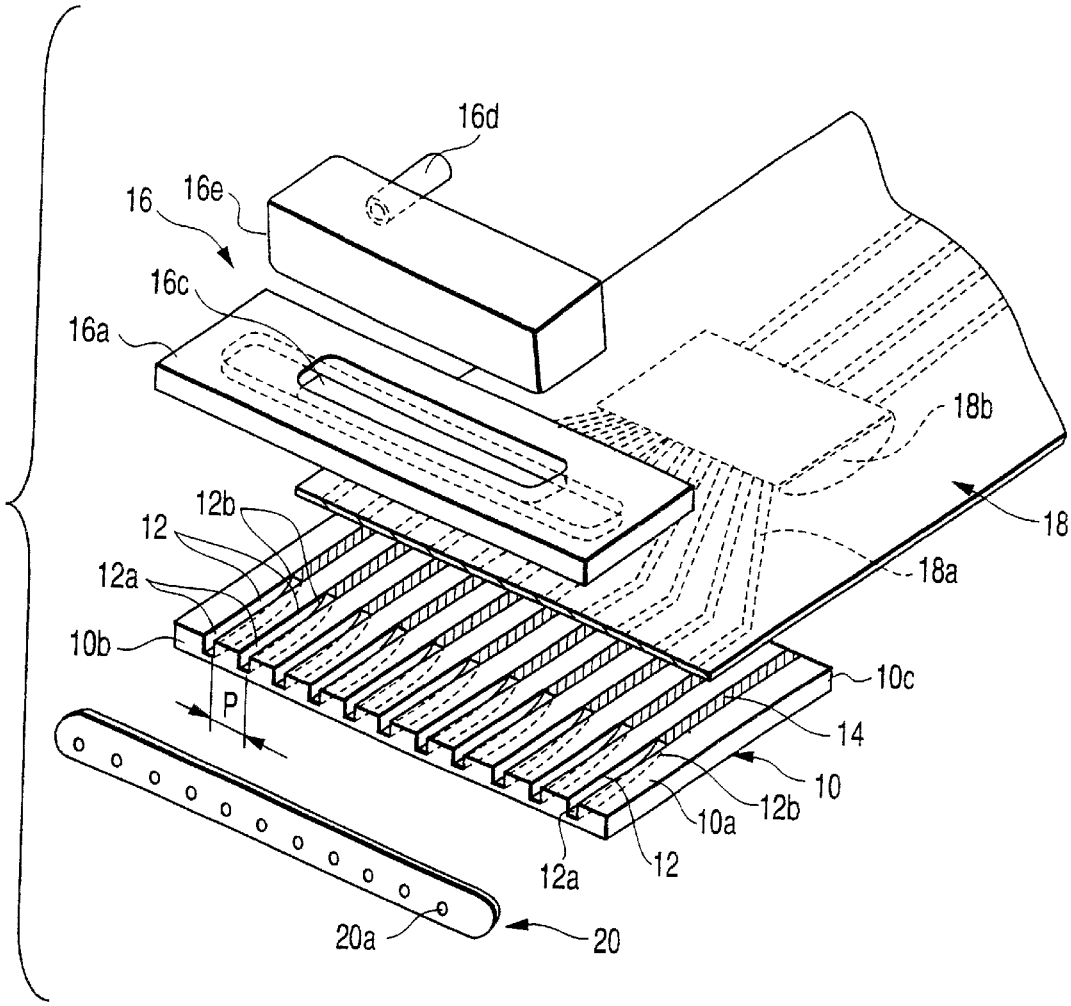
FIG. 1 (PRIOR ART)
FIG. 1 is an exploded perspective view schematically showing an ink jet head of prior art 1.
Figure 2:
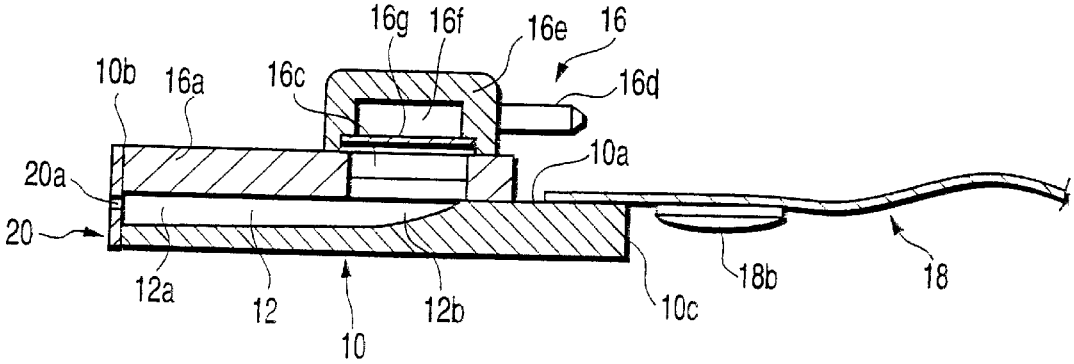
FIG. 2 (PRIOR ART)
FIG. 2 is a vertical cross sectional view schematically showing the conventional ink jet head shown in FIG. 1.
Figure 3:
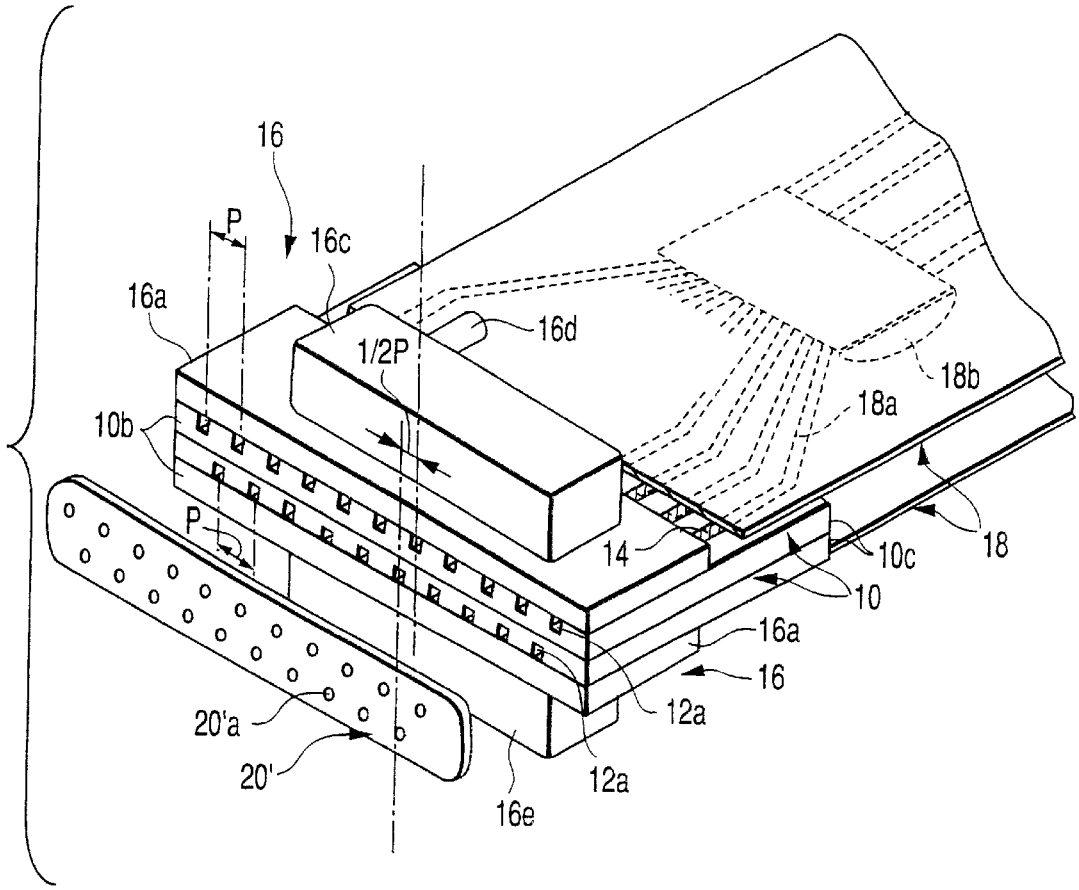
FIG. 3 (PRIOR ART)
FIG. 3 is an exploded perspective view schematically showing an ink jet head of prior art 2.
Figure 4:
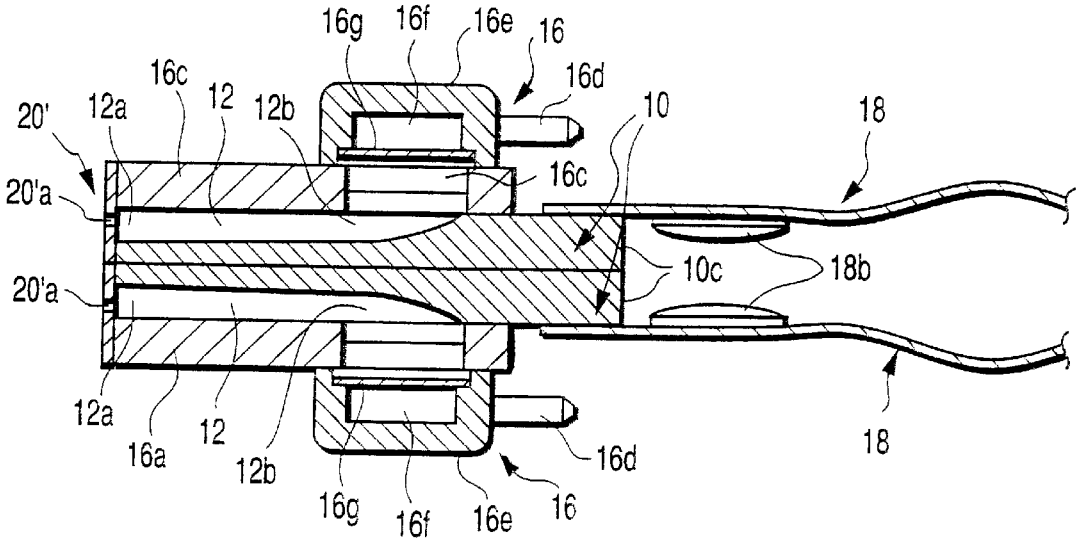
FIG. 4 (PRIOR ART)
FIG. 4 is a vertical cross sectional view schematically showing the conventional ink jet head shown in FIG. 3.
Figure 5:
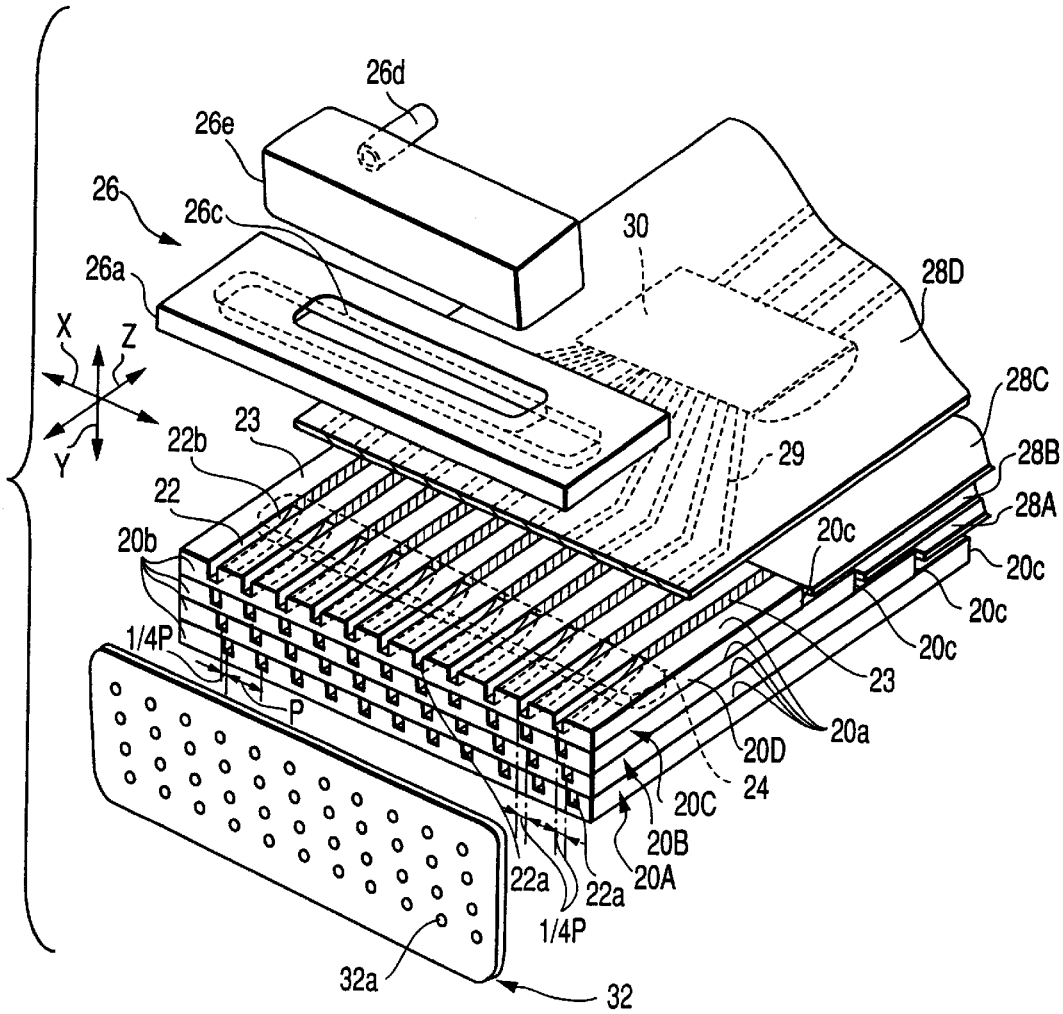
FIG. 5 is an exploded perspective view schematically showing in an ink jet head according to a first embodiment of the present invention.
Figure 6:
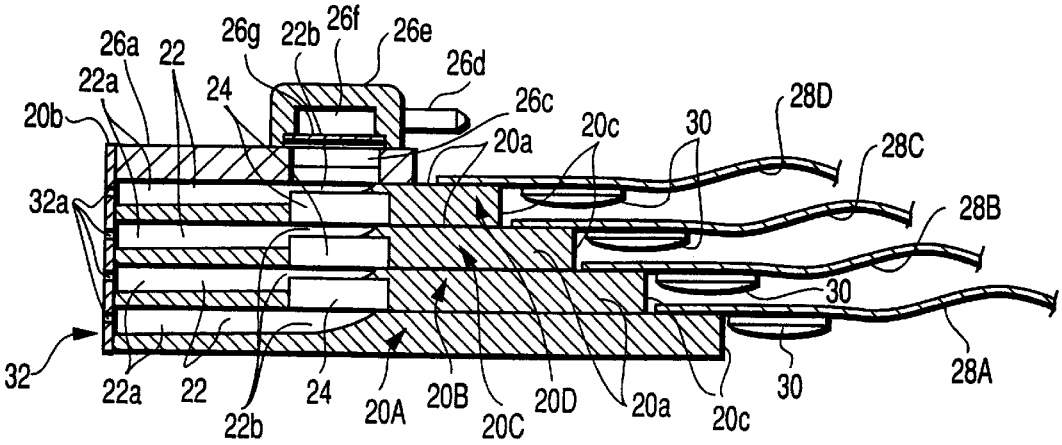
FIG. 6 is a vertical cross sectional view schematically showing the ink jet head shown in FIG. 5.

An ink jet head according to a first embodiment of the present invention, which is a kind of the apparatus for ejecting liquid droplets of the present invention, will now be described with reference to FIGS. 5 and 6. FIG. 5 is an exploded perspective view schematically showing an ink jet head, which is a kind of the apparatus for ejecting liquid droplets, according to a first embodiment of the present invention, and FIG. 6 is a vertical cross sectional view schematically showing the ink jet head shown in FIG. 5.

The ink jet head according to the first embodiment of the present invention is a share mode type ink jet head. As shown in FIGS. 5 and 6, the ink jet head according to the first embodiment of the present invention includes thin and flat four rectangular piezoelectric bodies 20A to 20D. These four piezoelectric bodies 20A to 20D are equal to each other in size, except that, concerning the size in a predetermined direction Z (see FIG. 5), the piezoelectric body 20A is larger than the piezoelectric body 20B, the piezoelectric body 20B is larger than the piezoelectric body 20C, and the piezoelectric body 20C is larger than the piezoelectric body 20D. Also, these four piezoelectric bodies 20A to 20D are substantially equal to each other in construction.

Each of these piezoelectric bodies 20A to 20D has a pair of a primary surfaces, a pair of end surfaces. Each of these piezoelectric bodies 20A to 20D has one primary surface 20*a*, the other primary surface opposite to the one primary surface 20*a*, one end surface 20*b* perpendicular to the one primary surface 20*a*, and the other end surface 20*c* opposite to the one end surface 20*b*. A plurality of parallel grooves 22 are arranged a predetermined distance P apart from each other in a predetermined arranging direction X (see FIG. 5) on the one primary surface 20*a* of each of the four piezoelectric bodies 20A to 20D. Each of the grooves 22 has a pair of ends. Each groove 22 extends in the Z-direction. Each groove 22 has one end 22*a* and the other end 22*b*. The grooves 22 are equal to each other in size. The one end 22*a* of each groove 22 is open in the one end surface 20*b* perpendicular to the one primary surface 20*a* in each of the piezoelectric bodies 20A to 20D so as to form a nozzle-side opening. Also, the other end 22*b* of each of the plural grooves 22 is made gradually shallower from the middle point of each groove in each of the piezoelectric bodies 20A to 20D. Each of the other end 22*b* fails to reach the other end surface 20*c*.

In each of the piezoelectric bodies 20A to 20D, the grooves 22 extend from the one end surface 20*b* toward the other end surface 20*c* by substantially the same distance. Also, an electrode is formed on the inner surface of each of the grooves 22.

Conductive patterns 23 acting as a conductive path electrically connected to the electrodes noted above extends in a region between the other end 22*b* and the other end surface 20*c* on the one primary surface 20*a* of each of the piezoelectric bodies 20A to 20D.

Each of the piezoelectric bodies 20A to 20D has two side surfaces perpendicular to the one primary surface 20*a* in addition to the one end surface 20*b* and the other end surface 20*c*. The four piezoelectric bodies 20A to 20D are stacked one upon the other and joined to each other under the state that the end surfaces 20*b* are arranged in the same plane, that each of the two side surfaces noted above is arranged on the same plane, and that the primary surfaces 20*a* are allowed to face the same direction. As a result, the four piezoelectric bodies 20A to 20D are stacked one upon the other such that the other end surfaces 20*c* form a stepwise configuration. In other words, the openings of the plural grooves 22 on the one primary surfaces 20*a* of each of the piezoelectric bodies 20A, 20B, 20C are covered with a back surface (the other primary surface) of the adjacent piezoelectric bodies 20B, 20C, 20D shorter than the piezoelectric bodies 20A, 20B, 20C, respectively.

It should also be noted that the one ends 22*a* of all the grooves 22 of the four piezoelectric bodies 20A to 20D face the same direction.

Each of the piezoelectric bodies 20B to 20D includes a liquid path element 24 arranged at a position apart from the one end 22*a* by the same distance in the Z-direction. The liquid path element extends from the bottom surface of each groove 22 through the back surface of the piezoelectric body, with the result that these liquid path elements collectively form a single liquid supply path. It follows that the liquid supply path faces all the openings of the grooves 22 on the one primary surface 20*a* of each of the adjacent piezoelectric bodies 20A, 20B, 20C on the side of the back surfaces of the piezoelectric bodies 20B, 20C, 20D.

Also, each of the piezoelectric bodies 20A to 20D is provided with a plurality of conductive patterns 23 corresponding to the grooves 22. The conductive pattern 23 extends from the other end surface 20*c* in the Z-direction so as to be connected to the electrode in each groove 22 in the other end 22*b* of the groove 22.

The ink jet head according to the first embodiment of the present invention also includes a liquid supply section 26. The liquid supply section 26 includes a terminal flange 26*a*. The terminal flange 26*a* is fixed to cover all the openings of the plural grooves 22 in the region where the plural grooves 22 on the one primary surface 20*a* of the piezoelectric body 20D are opened. An ink outlet port 26*c* communicating with the liquid supply path 24 is formed in the terminal flange 26*a*. The ink outlet port 26 is positioned to face all the grooves 22 on the one primary surface 20*a* of the piezoelectric body 20D.

The liquid supply section 26 also includes a small ink container 26*e* provided with a connection plug 26*d*. A flexible ink supply pipe (not shown) extending from an ink supply source such as an ink tank is connected to the connection plug 26. The small ink container 26*e* includes an ink reservoir 26*f*. The ink from the ink supply pipe flows through the connection plug 26*d* into the ink reservoir 26*f*. The small ink container 26*e* is fixed to the back surface opposite to the one primary surface 20*a* of the piezoelectric body 20D such that the ink reservoir 26*f* covers the ink outlet port 26*c*. Incidentally, an ink filter 26*g* is arranged within the ink reservoir 26*f*.

The ink jet head according to the first embodiment of the present invention also includes flexible substrates 28A to 28D. One end portion of each of these flexible substrates 28A, 28B, 28C, 28D is connected to the region where the plural conductive patterns 23 are formed on the one primary surface 20*a* of each of the piezoelectric bodies 20A to 20D. A plurality of conductive patterns 29 electrically connected to the plural conductive patterns 23 of the corresponding piezoelectric bodies 20A to 20D are formed in the flexible substrates 28A to 28D. Also, a driving circuit 30 for selectively transmitting as a driving signal the voltage of the external power source (not shown) to the conductive patterns 23 of the corresponding piezoelectric bodies 20A to 20D is fixed to each of the flexible substrates 28A to 28D.

As described previously, the piezoelectric bodies 20A to 20D are stacked one upon the other to form a stepwise configuration. As a result, the one primary surface 20*a* on the side of the other end surface 20*c* is exposed to the outside. The flexible substrates 28A to 28D permit the conductive pattern 29 to be connected to the corresponding conductive pattern 23 in the exposed region. As a result, each of the driving circuits 30 can be arranged adjacent to the other end surfaces 20*c* of the corresponding piezoelectric bodies 20A to 20D without being obstructed by the adjacent piezoelectric bodies 20B, 20C, 20D.

Because of the construction described above, it is possible to set the distance between the electrode of each of the piezoelectric bodies 20A to 20D and the driving circuit 30 as short as possible. Also, the particular construction makes it possible for the ink jet head according to the first embodiment of the present invention to lower the probability for the noise to be mixed in the electric signal (voltage change signal) supplied from the driving circuit 30 to the electrode in the conductive path extending from the driving circuit 30 to the plural electrodes and to lower the attenuation rate of the electric signal (voltage change signal) noted above. In other words, the ink jet head according to the first embodiment of the present invention permits markedly lowering the probability that the ink jet head is not ejected a desired amount of ink at a desired timing in printing a desired image. Thereby, the ink jet head is prevented the quality of the printing from being deteriorated.

A nozzle plate 32 covering the nozzle-side openings (openings of the one ends 22*a* of the groove 22) is fixed to the surface formed by the end surfaces 20*b* of the four piezoelectric bodies 20A to 20D. A plurality of nozzles 32*a* substantially aligned with the central positions of the nozzle-side openings are formed in the nozzle plate 32. Also, an ink repelling treatment is applied to the outer surface of the nozzle plate 32.

In the first embodiment of the present invention, when the four piezoelectric bodies 20A to 20D are stacked one upon the other and joined to each other, the nozzle-side openings of the piezoelectric bodies 20A to 20D are formed such that the nozzle-side openings of a certain piezoelectric body are deviated by ¼P in the arranging direction X of nozzle-side openings from the nozzle-side openings of the adjacent piezoelectric body. It follows that the ink jet head according to the first embodiment of the present invention has a nozzle density four times as high as that of the ink jet head formed of a single piezoelectric body 20A, 20B, 20C or 20D. In other words, the ink jet nozzle according to the first embodiment of the present invention has a nozzle density two times as high as that of the ink jet nozzle formed of two piezoelectric bodies. To be more specific, where each of the piezoelectric bodies 20A to 20D has a nozzle density of 180 dpi, the ink jet nozzle according to the first embodiment of the present invention has a nozzle density of 720 dpi.

In the ink jet nozzle according to the first embodiment of the present invention, which is configured as described above, the ink in the ink supply source is pressurized first so as to supply the ink into the ink reservoir 26*f* of the small ink container 26*e* through the ink supply pipe and the connection plug 26*d*. The ink supplied into the ink reservoir 26*f* flows into the liquid supply path 24 through the ink filter 26*g* and the ink outlet port 26*c* and, then, flows into the plural grooves 12. It is possible for the ink filling the plural grooves 12 to leak to the outside through the nozzle 32*a*. However, the leaking ink is repelled by the outer surface of the nozzle plate 32 and, thus, is not attached to the outer surface of the nozzle plate 32.

In the next step, the pressurization of the ink is released in the ink jet head. As a result, the ink within the groove 22 is a negative pressure relative to the atmospheric pressure. It follows that the ink forms a meniscus because of the surface tension within each nozzle 32*a*.

Under the state noted above, the driving circuit 30 on each of the flexible substrates 28A to 28D selectively applies a driving signal (driving voltage) to the electrode within the groove 22 in accordance with the control signal generated from a control circuit (not shown). For example, the control circuit is the control circuit of a personal computer connected to the ink jet printer using the ink jet head according to the first embodiment of the present invention. As a result, the side surface of the groove 12 corresponding to the electrode to which is impressed the driving voltage is deformed so as to reduce the lateral cross sectional area. Because of the change in the lateral cross sectional area, the ink within each groove 22 receives a shock wave, with the result that a predetermined amount of ink is ejected outward in the form of ink droplets from the nozzle 32*a*.

As described above, each of the piezoelectric bodies 20A to 20D is ink jet unit. In each of the grooves 22, said one end is the ink ejecting sections ejecting ink, the other end is ink supply portions supplying ink to each of the grooves 22, and the region between the ink supply portion and the ink jet section is a ink chamber. The ink chamber is storing the ink supplied from the ink supply portion.

As described above, the ink jet head according to the first embodiment of the present invention comprises four piezoelectric bodies 20A to 20D stacked one upon the other so as to increase the nozzle density. It should be noted that the four piezoelectric bodies 20A to 20D are stacked one upon the other such that the primary surfaces 20*a* of the four piezoelectric bodies 20A to 20D form a stepwise configuration on the side of the second side ends 20*c*. It follows that, in the ink head according to the first embodiment of the present invention, it is possible to connect easily the conductive pattern 29 to the corresponding conductive pattern 23 by joining the flexible substrates 28A to 28D to the region of the stepwise configuration.

It should also be noted that, in the ink jet head according to the first embodiment of the present invention, a common liquid supply path is formed in the four piezoelectric bodies 20A to 20D. As a result, it is possible to supply a sufficiently large amount of ink to each of the plural grooves 22 of each of the four piezoelectric bodies 20A to 20D by using only one liquid supply section 26 in the ink jet head according to the first embodiment of the present invention.

Because of the particular construction described above, the ink jet head according to the first embodiment of the present invention permits making compact the outer shape size, and also permits increasing the nozzle density. Also, in the ink jet head according to the first embodiment of the present invention, the liquid supply section 26 need not be mounted to each piezoelectric body. In addition, the construction of the ink jet head can be simplified so as to lower the manufacturing cost, to miniaturize the outer shape size, and to make the ink jet head lightweight.

(Second Embodiment)

Figure 7:
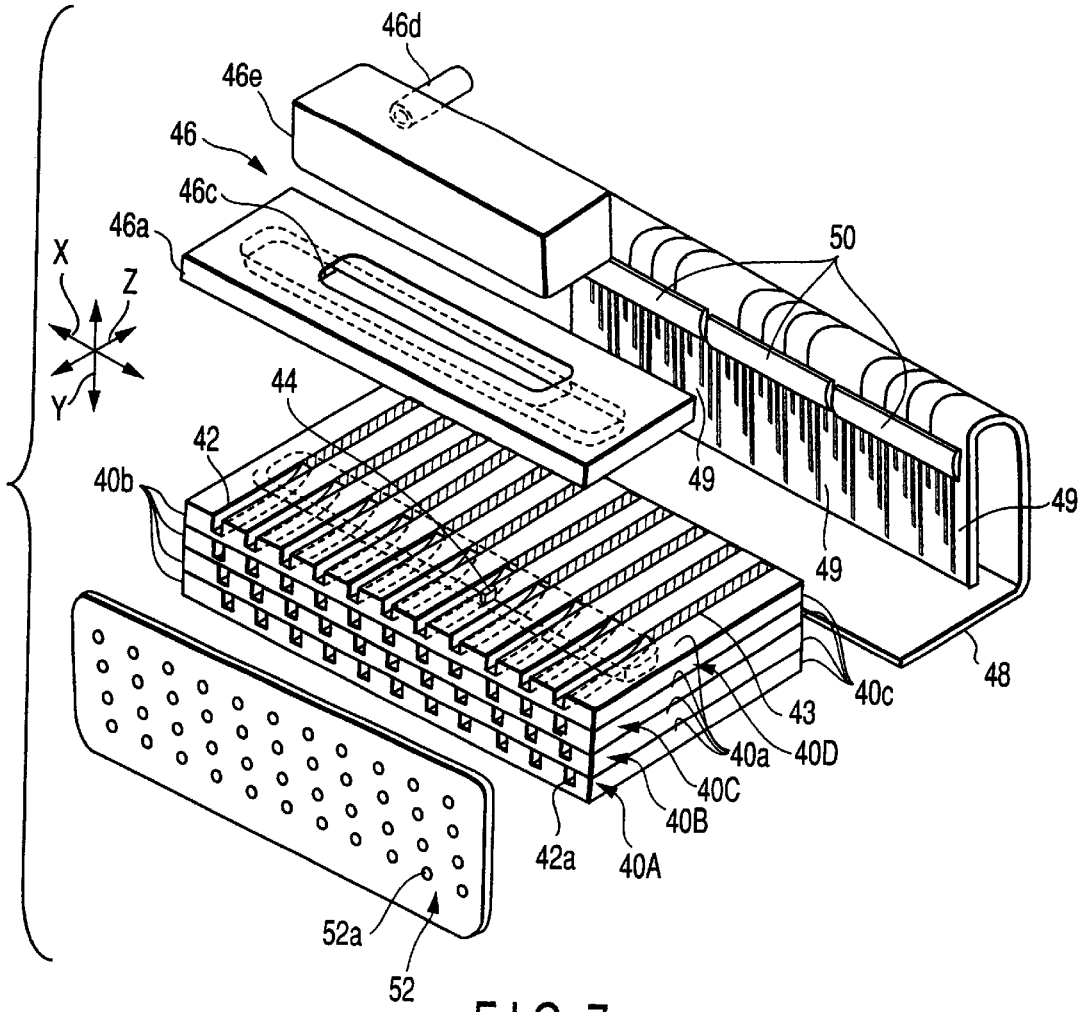
FIG. 7 is an exploded perspective view schematically showing an ink jet head according to a second embodiment of the present invention.
Figure 9:
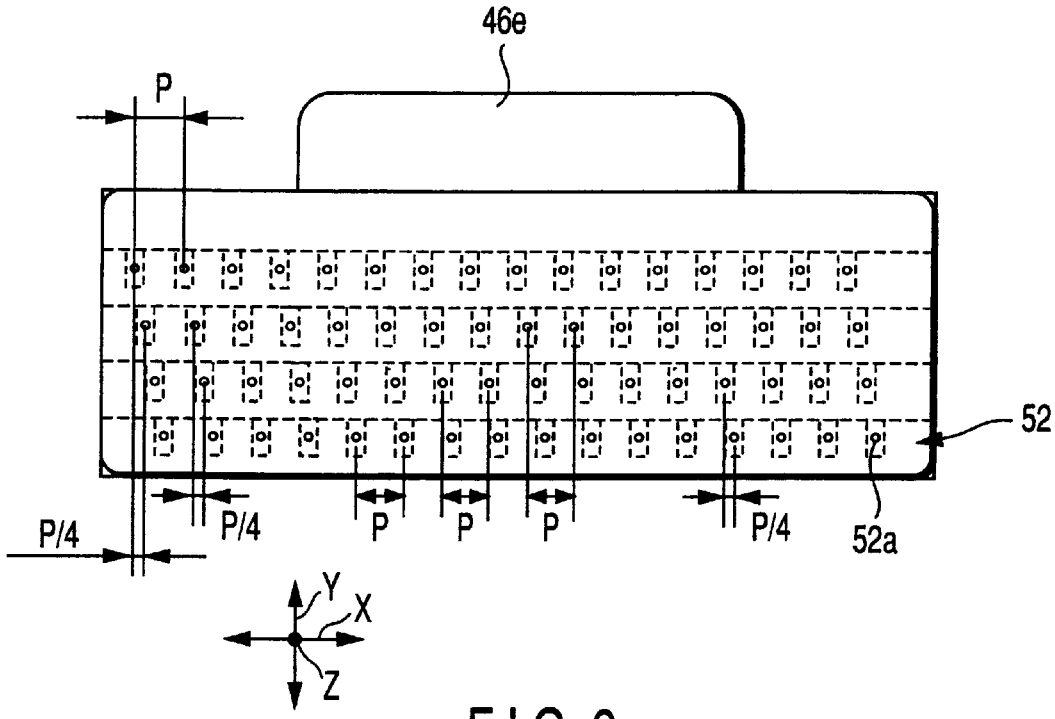
FIG. 9 is a front view schematically showing the arrangement of the nozzles included in the ink jet head shown in FIG. 7.
Figure 10:
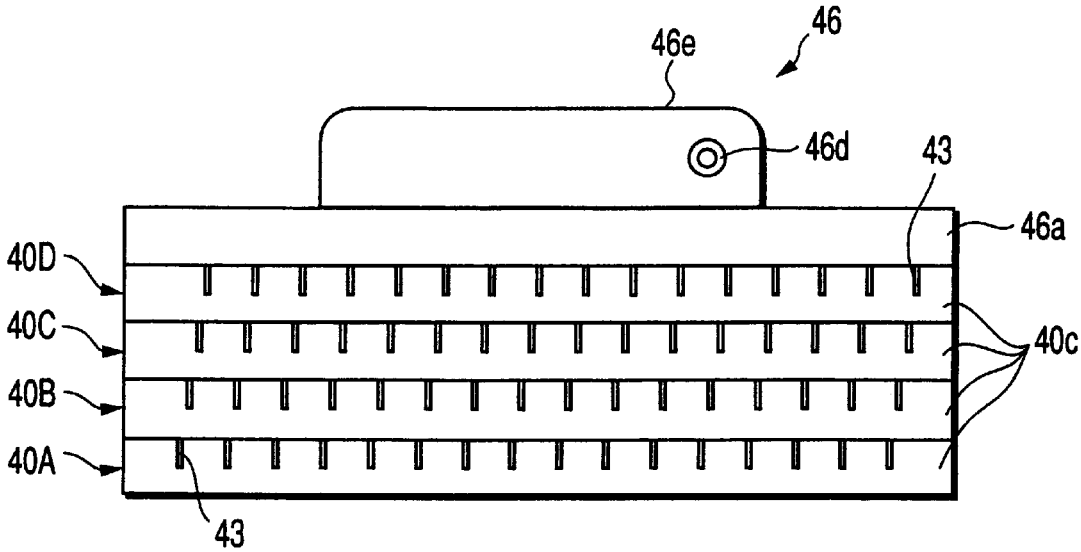
FIG. 10 is a rear view schematically showing the arrangement of the conductive paths included in the ink jet head shown in FIG. 7.

An ink jet head according to a second embodiment of the present invention, which is a kind of the apparatus for ejecting liquid droplets of the present invention, will now be described in detail with reference to FIGS. 7 to 10. FIG. 7 is an exploded perspective view schematically showing the ink jet head according to the second embodiment of the present invention, FIG. 8 is a vertical cross sectional view schematically showing the ink jet head shown in FIG. 7, FIG. 9 is a front view schematically showing the arrangement of a large number of nozzles of the ink jet head shown in FIG. 7, and FIG. 10 is a rear view schematically showing the arrangement of the conductive patterns forming the conductive path of the ink jet head shown in FIG. 7.

The ink jet head according to the second embodiment of the present invention is also of a share mode type.

Figure 8:
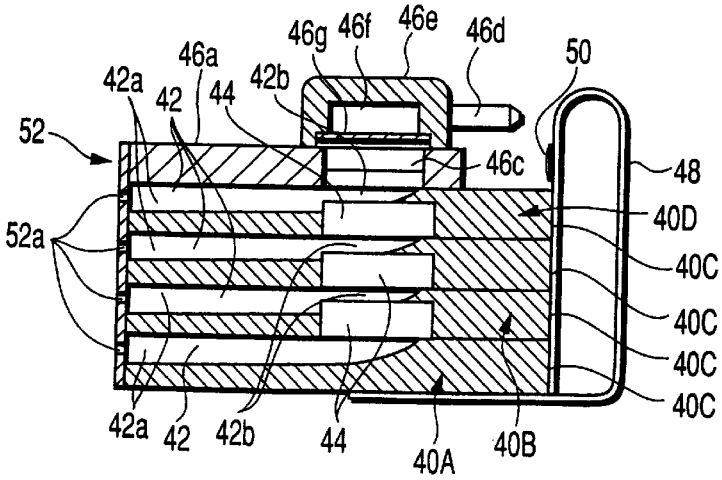
FIG. 8 is a vertical cross sectional view schematically showing the ink jet head shown in FIG. 7.

As shown in FIGS. 7 and 8, the ink jet head according to the second embodiment of the present invention includes thin and flat four rectangular piezoelectric bodies 40A, 40B, 40C, and 40D. These four piezoelectric bodies 40A to 40D are equal to each other in the outer shape size and in construction.

A plurality of parallel grooves 42 are formed a predetermined distance P apart from each other in the X-direction on one primary surface 40*a* of each of the piezoelectric bodies 40A to 40D. The grooves 42 are equal to each other in size. In each of the piezoelectric bodies 40A to 40D, one end 42*a* of each groove 42 has a nozzle-side opening in one end surface 40*b* perpendicular to the one primary surface 40*a*. Also, the other end 42*b* of each groove 42 is made gradually shallower and does not extend to reach the other end surface 40*c* perpendicular to the one primary surface 40*a*.

In each of the piezoelectric bodies 40A to 40D, the plural grooves 42 extend from one end surface 40*b* toward the other end surface 40*c* by the same distance. Also, an electrode is formed on the inner surface of each of the plural grooves 42.

A plurality of conductive patterns 43 are formed in each of the piezoelectric bodies 40A to 40D in a manner to correspond to the plural grooves 42. The conductive pattern 23 extends from the other end surface 40*c* in the Z-direction so as to be connected to the electrode of each groove 22 in the other end 42*b* of the groove 42. Particular, the extending end portion of the conductive pattern 43 extends to reach the other end surface 40*c* of each of the four piezoelectric bodies 40A to 40D, as clearly seen from FIG. 10.

The four piezoelectric bodies 40A to 40D are stacked one upon the other under the state that the one end surfaces 40*b* of the four piezoelectric bodies 40A to 40D are arranged on the same plane, that each of the side surfaces of the four piezoelectric bodies 40A to 40D is arranged on the same plane, and that the one primary surfaces 40*a* of the four piezoelectric bodies 40A to 40D are allowed to face the same direction. As a result, the other end surfaces 40*c* of the four piezoelectric bodies 40A to 40D are also arranged on the same plane.

Because of the particular construction, the openings of the plural grooves 42 on the one primary surfaces 40*a* of the piezoelectric bodies 40A, 40B, 40C are covered with the back surfaces (the other primary surfaces) of the adjacent piezoelectric bodies 40B, 40C, 40D, respectively. Also, the one ends 42*a* of all the grooves 42 of the four piezoelectric bodies 40A to 40D are allowed to face the same direction.

A liquid path element 44 is formed in each of the piezoelectric bodies 40B, 40C, and 40D in a position apart from the one end 40*b* by a predetermined distance in the Z-direction. The liquid path element 44 is formed to extend from the bottom surface of the groove 42 to reach the back surface of the piezoelectric body. These liquid path elements 44 collectively form a single liquid supply path. It follows that the liquid supply path faces the openings of all the grooves 42 on the one primary surface 40*a* of each of the adjacent piezoelectric bodies 40B, 40C, and 40D on the side of the back surface of the piezoelectric body.

The ink jet head according to the second embodiment of the present invention includes a liquid supply section 46 equipped with a terminal flange 46*a*. The terminal flange 46*a* is fixed to cover all the openings of the plural grooves 42 in the region where the plural openings 42 of the one primary surface 40*a* of the piezoelectric body 40D are opened. An ink outlet port 46*c* communicating with the liquid supply path 44 is formed in the terminal flange 46*a*. The ink outlet port 46 is positioned to face all the grooves 42 on the one primary surface 40*a* of the piezoelectric body 40D.

The liquid supply section 46 also includes a small ink container 46*e* equipped with a connection plug 46*d*. A flexible ink supply pipe (not shown) extending from an ink supply source such as an ink tank (not shown) is connected to the connection plug 46*d*. The small ink container 46*e* includes an ink reservoir 46*f* into which the ink from the ink supply pipe flows through the connection plug 46*d*. The small ink container 46*e* is fixed to permit ink reservoir 46*f* to cover the ink outlet port 46*c* on the surface opposite to the primary surface 40*a* of the piezoelectric body 40D in the terminal flange 46*a*. Incidentally, an ink filter 46*g* is arranged within the ink reservoir 46*f*.

Figure 11:
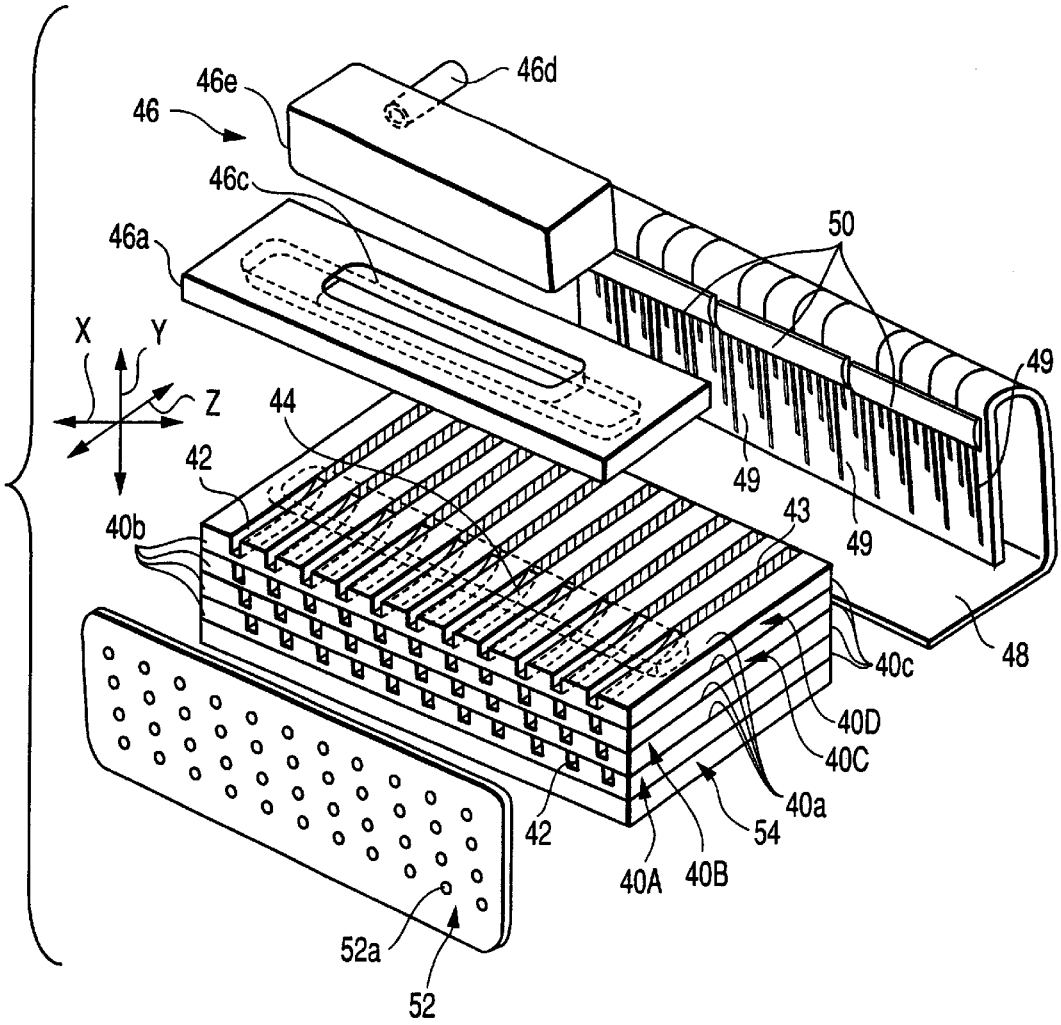
FIG. 11 is an exploded perspective view schematically showing the ink jet head according to a first modification of the second embodiment of the present invention.

It should be noted that the ink jet head according to the second embodiment of the present invention includes a single flexible substrate 48 having a one end and the other end. The one end of the flexible substrate 48 is attached to the other end surfaces 40*c* of all of the four piezoelectric bodies 40A to 40D. All the conductive patterns 49 connected to conductive patterns 43 of the four piezoelectric bodies 40A to 40D are formed in the flexible substrate 48. As shown in FIG. 11, a set including four conductive patterns 49 differing from each other in the length from one end of the flexible substrate 48 is formed in the flexible substrate 48 so as to permit the conductive patterns 49 to be connected to the conductive patterns 43. A plurality of sets noted above is formed in the flexible substrate 48. To be more specific, the conductive pattern 49 connected to the piezoelectric body 40A is formed longer than the conductive pattern 49 connected to the piezoelectric body 40B, the conductive pattern 49 connected to the piezoelectric body 40B is formed longer than the conductive pattern 49 connected to the piezoelectric body 40C, and the conductive pattern 49 connected to the piezoelectric body 40C is formed longer than the conductive pattern 49 connected to the piezoelectric body 40D, because the piezoelectric bodies 40A, 40B, 40C and 40D are stacked one upon the other in the order mentioned with the piezoelectric body 40A occupying the lowermost position.

Four driving circuits 50 are fixed to those regions of the flexible substrate 48 which are joined to the other end surfaces 40*c* of the piezoelectric bodies. These four driving circuits 50 are used for controlling the electric signal (voltage change signal) supplied to the electrodes of the grooves 42 of the four piezoelectric bodies 40A to 40D through the conductive patterns 49 and the conductive patterns 43.

The end portions of the flexible substrate 48 remote from the joining regions noted above are joined to the sides of the other end surfaces 40*c* of the primary surface 40*a* of the piezoelectric body 40A.

The four driving circuits 50 are arranged adjacent to all the other end surfaces 40*c* of the four piezoelectric bodies 40A to 40D in the second embodiment of the present invention, too. As a result, it is possible to make the distance between the four driving circuits 50 and the electrodes of the four piezoelectric bodies 40A to 40D as short as possible. If the distance between the driving circuits 50 and the electrodes of the grooves 42 of the piezoelectric bodies 40A to 40D is increased, the electrostatic capacitance generated in the electrodes is increased. If the electrostatic capacitance is increased, it is difficult to impress a sufficiently high voltage to the piezoelectric body, with the result that it is impossible to perform the ink ejecting at a desired speed and in a desired amount. In the second embodiment of the present invention, however, the driving circuits 50 are arranged close to the piezoelectric bodies 40A to 40D as described above so as to make it possible to achieve a desired ink ejecting.

In addition, even if compared with the first embodiment, the nonuniformity in the lengths of the conductive paths between the electrodes of the piezoelectric bodies 40A to 40C and the driving circuits 50 is provided by only the thickness of the piezoelectric bodies. Since the nonuniformity in the lengths of the conductive paths is very small, the difference in the electrostatic capacitance among the piezoelectric bodies can be decreased to a small value.

A nozzle plate 52 covering the nozzle-side openings (openings of the one ends 42*a* of the grooves 42) is fixed to the same surface formed of the end surfaces of the four piezoelectric bodies 40A to 40D that are stacked one upon the other. A plurality of nozzles 52*a* substantially aligned with the central positions of the nozzle-side openings are formed in the nozzle plate 52. Also, an ink repelling treatment is applied to the outer surface of the nozzle plate 52.

In the second embodiment of the present invention, the nozzle-side openings of the piezoelectric bodies 40A to 40D are formed such that, when the four piezoelectric bodies 40A to 40D are stacked one upon the other and joined to each other, the nozzle-side openings of a certain piezoelectric body are deviated by ¼P in the arranging direction X of the nozzle-side openings from the nozzle-side openings of the adjacent piezoelectric body. It follows that the ink jet head according to the first embodiment of the present invention has a nozzle density four times as high as that of the ink jet head formed of a single piezoelectric body, e.g., the piezoelectric body 40A alone. In other words, the ink jet nozzle according to the second embodiment of the present invention has a nozzle density two times as high as that of the ink jet nozzle formed of two piezoelectric bodies. To be more specific, where each of the piezoelectric bodies 40A to 40D has a nozzle density of 180 dpi, the ink jet nozzle according to the second embodiment of the present invention has a nozzle density of 720 dpi.

The ink jet head according to the second embodiment of the present invention, which is configured as described above, performs the function similar to that performed by the ink jet head according to the first embodiment of the present invention described previously. However, the second embodiment differs from the first embodiment in that (1) the four piezoelectric bodies 40A to 40*d* are equal to each other in the outer shape size, (2) used is only one flexible substrate 48 equipped with the driving circuits 50, (3) the flexible substrate 48 is attached to all the other end surfaces 40*c* of the four piezoelectric bodies 40A to 40D, and (4) the lengths between the electrodes of the four piezoelectric bodies 40A to 40D and the driving circuits 50 are short and the nonuniformity in the lengths noted above is small for every piezoelectric body.

Because of the particular construction described above, the ink jet nozzle according to the second embodiment of the present invention has of course a high nozzle density. In addition, since the four piezoelectric bodies have the same outer shape sizes, the manufacturing cost can be reduced. Further, the ink jet head can be miniaturized and can be made lightweight. Also, only one flexible substrate is used in the ink jet head according to the second embodiment of the present invention so as to facilitate the arrangement of the flexible substrate and to make the construction compact. Further, the ink jet head according to the second embodiment of the present invention permits exhibiting desired ink ejecting characteristics so as to obtain a printed image of a higher quality.

It should also be noted that a liquid supply path common to the four piezoelectric bodies 40A to 40D is used in the ink jet head according to the second embodiment of the present invention. In other words, in the ink jet head according to the second embodiment of the present invention, it is possible to supply a sufficiently large amount of an ink to the plural grooves 42 of the piezoelectric bodies 40A to 40*d* by using only one liquid supply section 46. It follows that it is possible to simplify the construction of the liquid supply section 46 in the ink jet head according to the second embodiment of the present invention so as to lower the manufacturing cost.

Incidentally, in the ink jet head according to the second embodiment of the present invention, an external connection conductive pattern (not shown) for transmitting a control signal generated from a control circuit (not shown) to the driving circuit 50 is formed on the outer surface of the flexible substrate 48, which faces the side opposite to the other end surfaces 40*c* of the piezoelectric bodies 40A to 40D. It follows that the ink jet head according to the second embodiment of the present invention can be formed as a cartridge type ink jet head that can be detached mechanically and electrically from the ink jet printer by mounting a socket that can be electrically connected to the external connection conductive pattern.

(First Modification of Second Embodiment)

Figure 12:
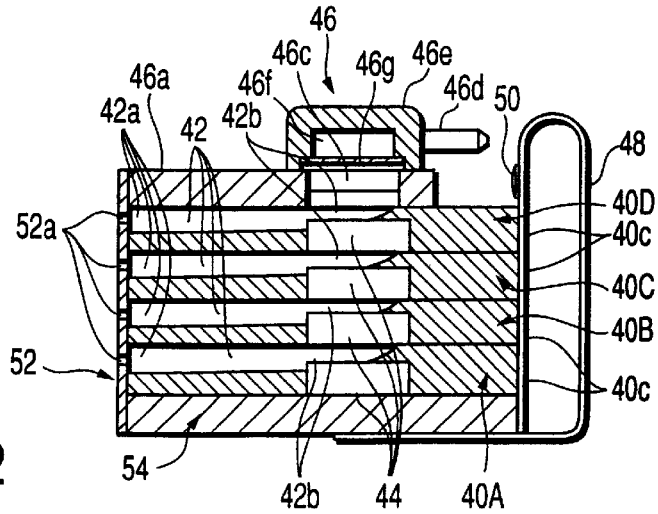
FIG. 12 is a vertical cross sectional view schematically showing the ink jet head shown in FIG. 11.

A first modification of the ink jet head according to the second embodiment of the present invention will now be described in detail with reference to FIGS. 11 and 12. FIG. 11 is an exploded perspective view schematically showing the ink jet head according to the first modification of the second embodiment, and FIG. 12 is a vertical cross sectional view schematically showing the ink jet head shown in FIG. 11.

The first modification is substantially equal to the second embodiment described above in major portion of the constituting members. The constituting members of the first modification equal to the constituting members of the second embodiment described above are denoted by the same reference numerals so as to avoid an overlapping description.

The first modification differs from the second embodiment described above in that the liquid path element 44 is formed in the piezoelectric body 40A, too, as well as in the other three piezoelectric bodies 40B to 40D. Therefore, in the first modification of the second embodiment, a closing member 54 is stacked on the back surface of the piezoelectric body 40A in order to close the opening of the liquid path element 44 in the back surface of the piezoelectric body 40A. The closing member 54 has a primary surface equal in the outer shape size to the primary surface 40*a* of each of the piezoelectric bodies 40A to 40D. Incidentally, it suffices for the outer shape size of the closing member 54 to be large enough to close the opening of the liquid path element 44 on the back surface of the piezoelectric body 40A.

The first modification of the second embodiment permits producing the effects similar to those produced by the second embodiment described above. Also, since the common liquid supply path is formed by forming the liquid path elements 44 of the same construction in the piezoelectric bodies 40A to 40D, it is possible to further reduce the manufacturing cost, compared with the second embodiment in which the piezoelectric body 40A alone does not have the liquid path element 44. Also, the piezoelectric body before formation of the grooves 42 and the liquid path element 44 can be used as the closing member 54 in the first modification of the second embodiment so as to save the labor for the supervision of the parts and to lower the manufacturing cost.

(Second Modification of Second Embodiment)

Figure 13:
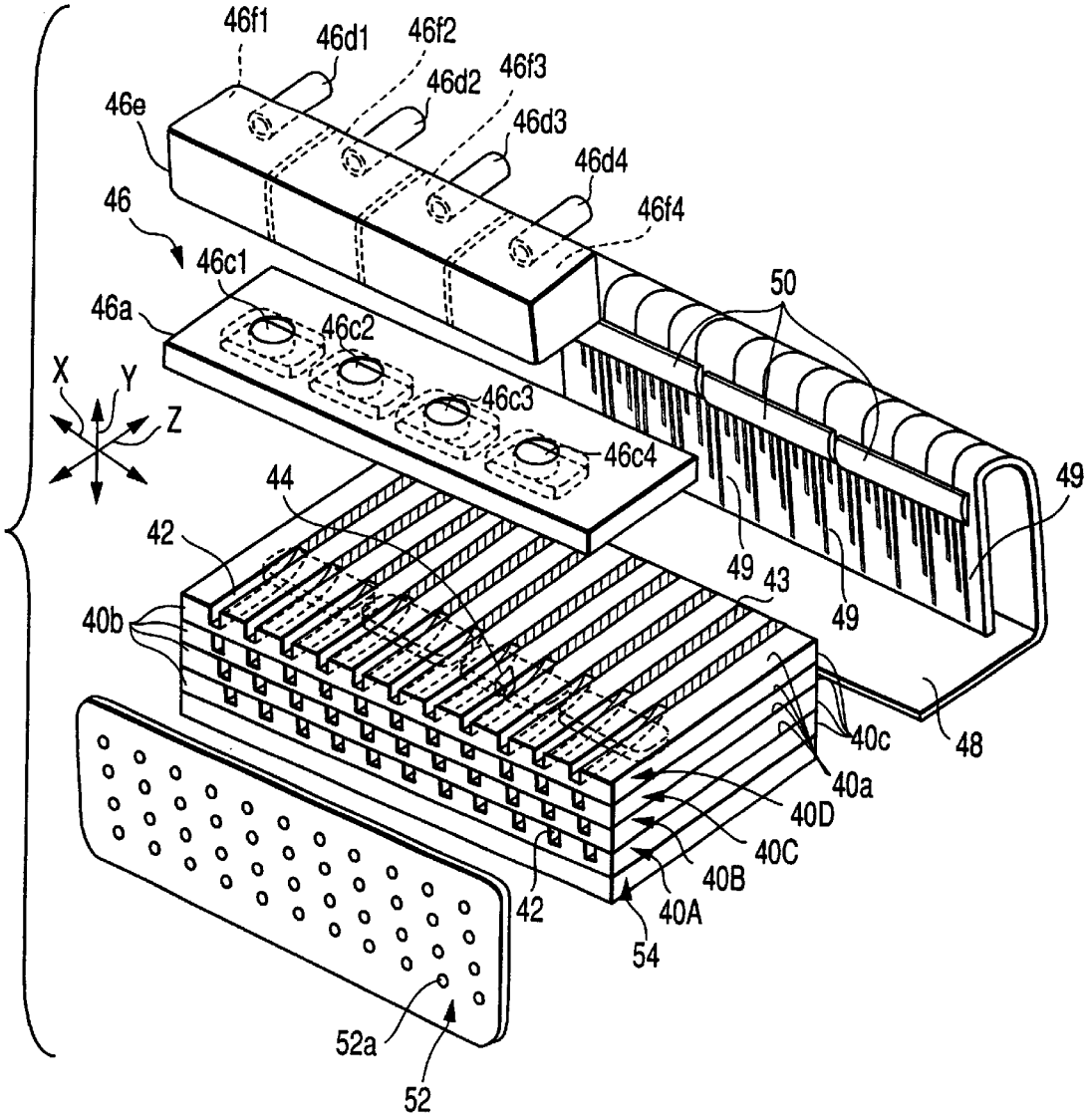
FIG. 13 is an exploded perspective view schematically showing the ink jet head according to a second modification of the second embodiment of the present invention.
Figure 14:
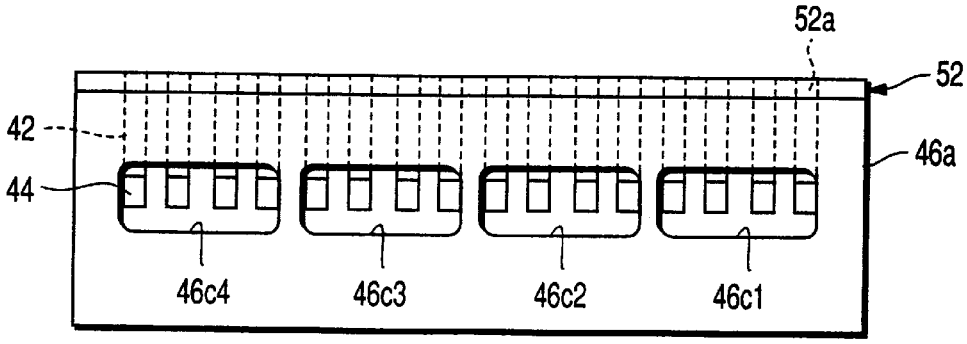
FIG. 14 is a plan view schematically showing the gist portion of the ink supply pipe included in the ink jet head shown in FIG. 13.

A second modification of the ink jet head according to the second embodiment of the present invention will now be described in detail with reference to FIGS. 13 and 14. FIG. 13 is an exploded perspective view schematically showing the ink jet head according to the second modification of the second embodiment, and FIG. 14 is a plan view schematically showing the gist portion of the ink supply pipe according to the second modification shown in FIG. 13.

The second modification is substantially equal to the first modification described above in major portion of the constituting members except the liquid supply section 46. The constituting members of the second modification equal to the constituting members of the first modification described above are denoted by the same reference numerals so as to avoid an overlapping description.

The second modification differs from the first modification described above in that the ink outlet port of the terminal flange 46*a* of the liquid supply section 46 is divided into small ink outlet ports 46*c*1, 46*c*2, 46*c*3 and 46*c*4. Also, the ink reservoir within the small ink container 46*e* covering the small ink outlet ports 46*c*1 to 46*c*4 is divided into a plurality of small ink reservoirs 46*f*1, 46*f*2, 46*f*3 and 46*f*4 in a manner to correspond to the plural small ink outlet ports 46*c*1 to 46*c*4. Further, the small ink reservoirs 46*f*1 to 46*f*4 are provided with connection plugs 46*d*1, 46*d*2, 46*d*3 and 46*d*4, respectively.

A flexible ink supply pipe (not shown) extending from an ink supply source such as an ink tank (not shown) is connected to each of the connection plugs 46*d*1 to 46*d*4. It is possible for a single ink tank or a plurality of ink tanks to be connected to each of the connection plugs 46*d*1 to 46*d*4. Where a plurality of ink tanks are connected to each of the connection plugs 46*d*1 to 46*d*4, it is possible to store inks of different colors in the ink tanks or to store an ink of the same color in the ink tanks. It is also possible to store different kinds of inks, the number of kinds being smaller than the number of ink tanks, in a plurality of ink tanks.

The ink jet head according to the second modification of the second embodiment includes four small ink outlet ports 46*c*1 to 46*c*4, four small ink reservoirs 46*f*1 to 46*f*4, and four connection plugs 46*d*1 to 46*d*4. The ink jet head according to the second modification may use inks having the maximum of four colors of, for example, black, cyan, magenta and yellow. However, it is possible to set the number of these small ink outlet ports, etc. at 2 or a desired number larger than 2.

As a result, the ink jet head according to the second modification of the second embodiment, which is compact, permits ejecting inks of a plurality of colors at a high density. Of course, the ink jet head according to the second modification permits producing the effects similar to those produced by the ink jet head according to the first modification of the second embodiment.

Incidentally, it is possible to apply the liquid supply section 46 in the second modification of the second embodiment to the ink jet head according to the first embodiment or the second embodiment of the present invention. In this case, the ink head according to the first embodiment or the second embodiment, which is compact, is enabled to produce the effect that it is possible to eject inks of a plurality of colors at a high density. In addition, compared with the case of using a plurality of ink jet heads in accordance with the inks of a plurality of colors, the position alignment of the ink jet heads is rendered unnecessary because inks of a plurality of colors can be ejected by using a single ink jet head.

(Third Embodiment)

Figure 15:
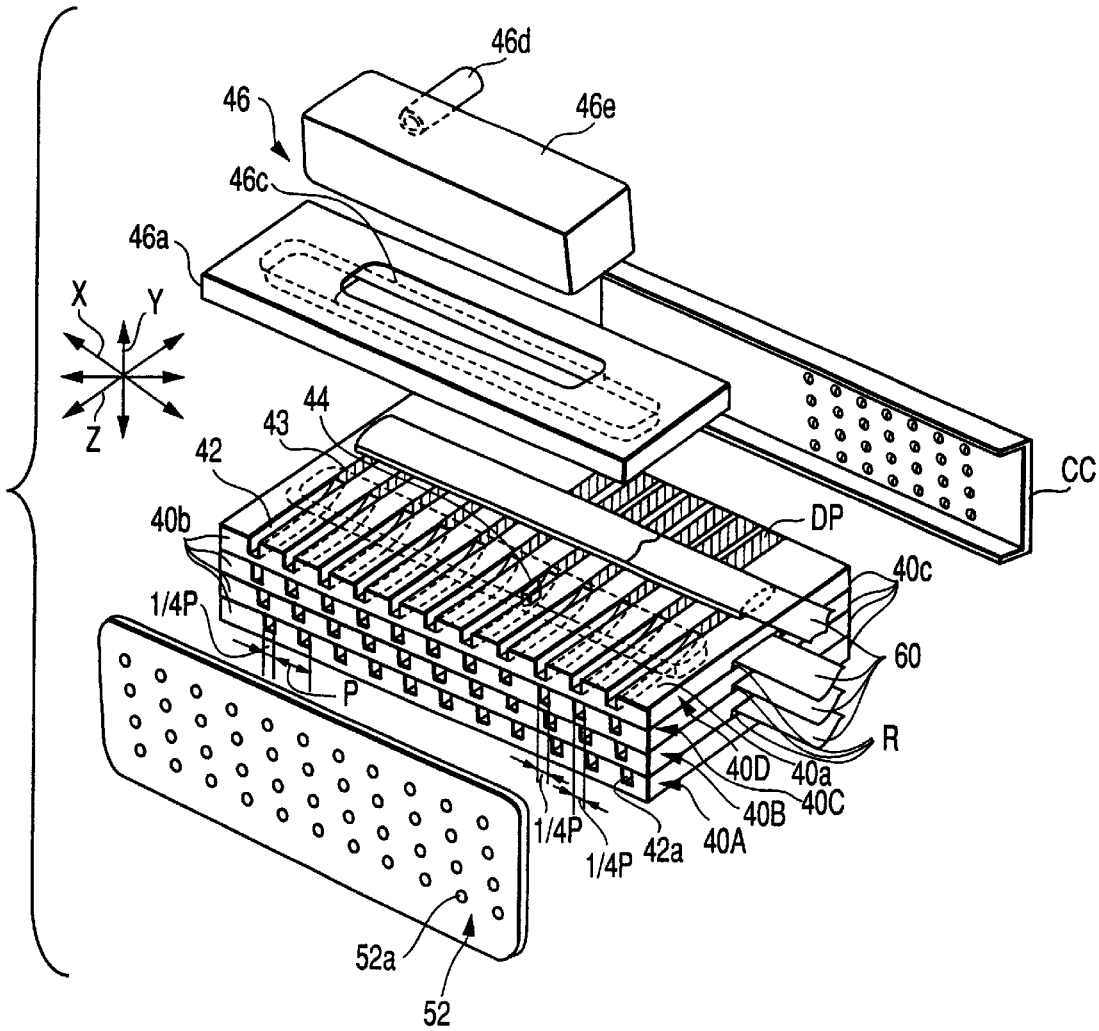
FIG. 15 is an exploded perspective view schematically showing an ink jet head according to a third embodiment of the present invention.
Figure 16:
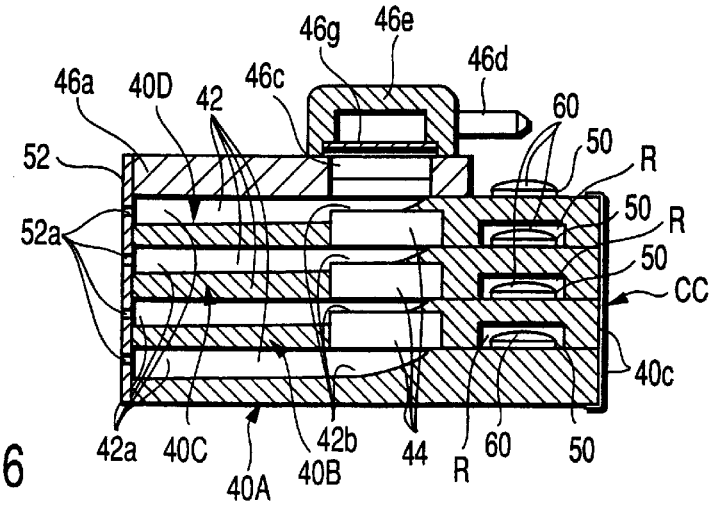
FIG. 16 is a vertical cross sectional view schematically showing the ink jet head shown in FIG. 15.
Figure 17:
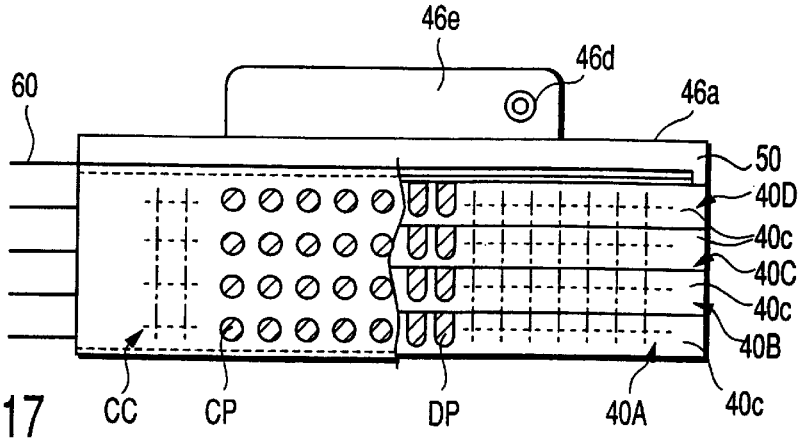
FIG. 17 is a front view schematically showing the arrangement of the electrical contacts included in the ink jet head shown in FIG. 15.

An ink jet head according to a third embodiment of the present invention, which is a kind of the apparatus for ejecting liquid droplets of the present invention, will now be described with reference to FIGS. 15 to 17. FIG. 15 is an exploded perspective view schematically showing the ink jet head according to the third embodiment of the present invention, FIG. 16 is a vertical cross sectional view schematically showing the ink jet head shown in FIG. 15, and FIG. 17 is a front view schematically showing the arrangement of the electrical contacts of the ink jet head shown in FIG. 15. The ink jet head according to the third embodiment of the present invention is also of a share mode type.

The ink jet head according to the third embodiment of the present invention is substantially equal to the ink jet head according to the second embodiment described previously in major portion of the constituting members. The constituting members of the third embodiment, which are equal to the constituting members of the second embodiment, are denoted by the same reference numerals so as to avoid an overlapping description.

The third embodiment differs from the second embodiment in that a recess R extending in the arranging direction X is formed in the other primary surface of each of the piezoelectric bodies 40B, 40C and 40D, though the recess R is not formed in the piezoelectric body 40A. These recesses R of piezoelectric bodies 40B to 40D are faced to portions of the one primary surfaces 40*a* of the piezoelectric bodies 40A to 40C on which are formed the conductive patterns 43.

Further, the driving circuits 50 are electrically connected and fixed to the conductive patterns 43 on the one primary surfaces of the piezoelectric bodies 40A to 40D. The driving circuits 50 are housed in the recesses R of the adjacent piezoelectric bodies 40B, 40C and 40D so as not to obstruct the predetermined stacking of the piezoelectric bodies 40A to 40D.

In the ink jet head according to the third embodiment of the present invention, a heat dissipating plate 60 for dissipating the heat generated from the driving circuit 50 is mounted to the driving circuit 50. The heat dissipating plates 60 project outward from the recesses R of the piezoelectric bodies 40A to 40D.

The ink jet head according to the third embodiment of the present invention also includes conductive patterns DP for the driving circuits. The patterns DP extend from the driving circuit 50 toward the other end surface 40*c* on the one primary surface 40*a* of each of the piezoelectric bodies 40A to 40D. As apparent from FIG. 17, the end of the conductive pattern DP for the driving circuit is positioned on the other end surface 40*c* of each of the piezoelectric bodies 40A to 40D.

A terminal plate CC is provided with a plurality of durable contacts CP electrically connected to the ends of the conductive patterns DP for a plurality of driving circuits. The terminal plate CC is fixed to the other end surfaces 40*c* of the stacked piezoelectric bodies 40A to 40C. The terminal plate CC may be a flexible substrate.

According to the ink jet head, the driving circuits 50 for the piezoelectric bodies 40A to 40C, which obstruct the stacking of the piezoelectric bodies, are housed in the recesses R formed in the piezoelectric bodies 40B to 40D so as to decrease the outer shape size of the ink jet head. Also, since the plural contacts CP for the driving circuits 50 are formed on the terminal plate CC, the terminal plate CC is adapted for use in a cartridge type ink jet head rather than in the ink jet head according to the second embodiment of the present invention.

The ink jet head according to the third embodiment of the present invention produces the effects similar to the effects produced by the ink jet head according to the second embodiment of the present invention.

It is possible to allow the ink jet head according to the third embodiment of the present invention to produce the effect similar to that produced by the first modification of the second embodiment by using the common liquid path elements 40 for forming a liquid supply path described previously in conjunction with the first modification of the second embodiment, and by closing the opening of the liquid path element 44 on the back surface of the piezoelectric body 40A by the closing member 54.

Further, it is possible to apply the liquid supply section 46 as in the second modification of the second embodiment to the ink jet head according to the third embodiment of the present invention. In this case, it is possible for a single ink jet head to produce the effect of ejecting inks of a plurality of colors at a high density.

The heat dissipating plate 60 serves to prevent the malfunction of the driving circuit 50 caused by the heat generated from the driving circuit 50. The heat dissipating plate 60 also serves to prevent the ink in the plural grooves 42 of the piezoelectric bodies 40A to 40D from being excessively heated to high temperatures. Incidentally, if the temperature of the ink is excessively elevated, the viscosity of the ink fails to fall within an appropriate range, with the result that the ejecting characteristics of the ink are changed. It follows that the image formed by the ejected ink is disturbed. Such being the situation, the heat dissipating plate is a constituent effective for printing an image of a high quality.

(Fourth Embodiment)

An ink jet head according to a fourth embodiment of the present invention, which is a kind of a apparatus for ejecting liquid droplets of the present invention, will now be described in detail with reference to FIGS. 18A and 18B.

Figure 18A:
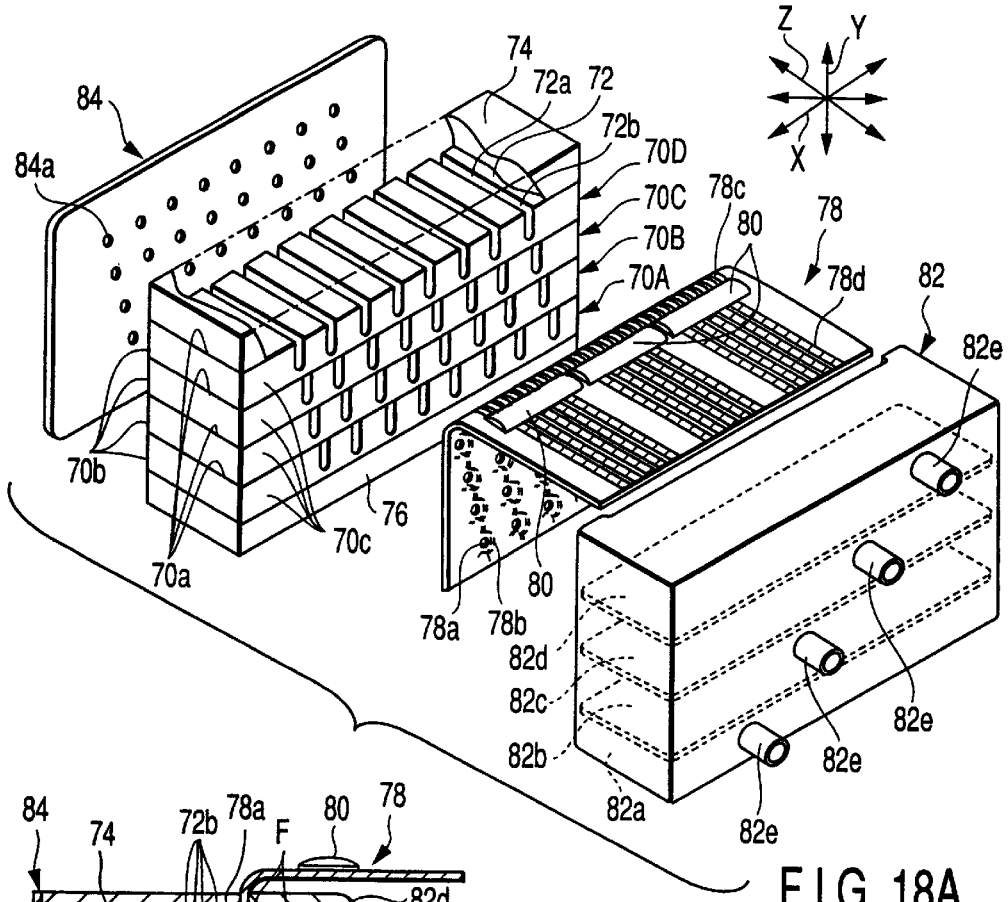
FIG. 18A is an exploded perspective view schematically showing an ink jet head according to a fourth embodiment of the present invention.
Figure 18B:
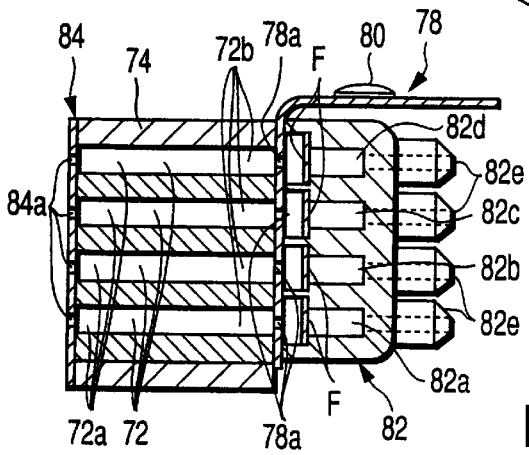
FIG. 18B is a vertical cross sectional view schematically showing the ink jet head shown in FIG. 18A.

FIG. 18A is an exploded perspective view schematically showing the ink jet head according to the fourth embodiment of the present invention. The ink jet head according to the fourth embodiment of the present invention is also of a share mode type.

As shown in FIG. 18A, the ink jet head according to the fourth embodiment of the present invention also includes thin and flat four rectangular piezoelectric bodies 70A, 70B, 70C and 70D. The piezoelectric bodies 70A to 70D are equal to each other in the outer shape size.

A plurality of parallel grooves 72 are formed a predetermined distance P apart from each other in a predetermined arranging direction X on the primary surfaces 70*a* of the piezoelectric bodies 70A to 70D. These plural grooves 72 are equal to each other in size. The one end 72*a* of each of the plural grooves 72 forms a nozzle-side opening, which is open on the one end surface 70*b* of each of the piezoelectric bodies 70A to 70D. The other end 72*b* of each of the plural grooves 72 is also open on the other end surface 70*c* perpendicular to the one primary surface 70*a* of each of the piezoelectric bodies 70A to 70D.

The plural grooves 72 are equal to each other in length in each of the piezoelectric bodies 70A to 70D. An electrode is mounted to the inner surface of each of these plural grooves 72. These electrodes are exposed in the vicinity of the opening on the other end 72*b* of the groove 72 on the other end surface 70*c* of the piezoelectric bodies 70A to 70D.

The piezoelectric bodies 70A to 70D are stacked one upon the other and joined to each other under the state that each of all the side surfaces including the one end surface 70*b* and the other end surface 70*b* is arranged on the same plane, and that the one primary surfaces 70*a* of all the piezoelectric bodies 70A to 70D are allowed to face the same direction. As a result, the openings of the plural grooves 72 on the one primary surfaces 70*a* of the three piezoelectric bodies 70A, 70B and 70C are covered with the other primary surface of the adjacent piezoelectric bodies 70B, 70C and 70D, respectively.

Incidentally, a protective member 74 equal to any of the piezoelectric bodies 70A to 70D in the outer shape and the size is mounted to the one primary surface 70*a* of the piezoelectric body 70D. Likewise, a protective member 76 equal to any of the piezoelectric bodies 70A to 70D in the outer shape and the size is mounted to the other primary surface of the piezoelectric body 70A.

A flexible substrate 78 is attached to the other end surfaces 70*c* of the piezoelectric bodies 70A to 70D.

A plurality of liquid supply openings 78*a* and a plurality of annular electrical contacts 78*b* are attached to the other end surfaces 70*c* of the piezoelectric bodies 70A to 70D. The liquid supply openings 78*a* is aligned with the openings on the side of the other ends 72*b* of the grooves 72 on the other end surfaces 70*c* of the piezoelectric bodies 70A to 70D. The electrical contacts 78*b* correspond to the electrical contacts around the openings 78*a*.

The annular electrical contacts 78*b* are electrically connected to a plurality of driving circuits 80 formed on the flexible substrate 78 through the conductive patterns 78*c* formed on the flexible substrate 78. The driving circuit 80 serves to supply an electric signal (voltage change signal) for controlling the operation to the electrical contact on the side of the piezoelectric body through the conductive pattern 78*c* and the annular electrical contact 78*b*.

Incidentally, a plurality of external connection conductive patterns 78*d* mounted on the flexible substrate 78 is electrically connected to the plural driving circuits 80. The driving circuit 80 receives a control signal generated from a control circuit (not shown) through the external connection conductive pattern 78*d*. For example, the control circuit is a control circuit of a personal computer connected to an ink jet printer using the ink jet head according to the fourth embodiment of the present invention.

A liquid supply small container 82 equipped with an ink reservoir covering all the openings of the piezoelectric bodies 70A to 70D is fixed to the back side of the portion where the flexible substrate 78 is attached to the piezoelectric bodies 70A to 70D. The ink reservoir of the liquid supply small container 82 is divided into a plurality of small sections 82*a*, 82*b*, 82*c* and 82*d* in the staking direction of the piezoelectric bodies 70A to 70D.

Further, connection plugs 82*e*, to which a flexible ink supply pipes (not shown) are connected, is connected to each of the plural small sections 82*a* to 82*d*. The flexible ink supply pipe (not shown) extends from an ink supply source such as an ink tank (not shown). Incidentally, an ink filter F is arranged in each of the plural small sections 82*a* to 82*d* of the ink reservoir.

It is possible to arrange the plural driving circuits 80 adjacent to the other end surfaces 70*c* of the piezoelectric bodies 70A to 70D in the fourth embodiment of the present invention, too. As a result, It is possible to set the distance between plural driving circuits 80 and plural grooves 72 of the piezoelectric bodies 70A to 70D as short as possible and to decrease the nonuniformity of the distance noted above. Also, it is possible to lower the probability for the noise to be mixed in the electric signal (voltage change signal) transmitted from the driving circuit 80 to the plural electrodes in the conductive path between the driving circuit 80 and the plural electrodes and to lower the attenuating rate of the electric signal (voltage change signal). It is also possible to allow the attenuating rates in the plural piezoelectric bodies to be substantially equal to each other. Thereby, the ink jet head according to the fourth embodiment of the present invention can eject a desired amount of an ink at a desired timing in printing a desired image. The ink jet head may be markedly lowered the probability of lowering the quality of the printing.

A nozzle plate 84 covering the nozzle-side openings of the four piezoelectric bodies 70A to 70D is fixed to the uniform surface region on the side of the end surface 70*b* of the stacked piezoelectric bodies 70A to 70D and the protective members 74, 76. A plurality of nozzles 84*a* substantially aligned with the central positions of the nozzle-side openings are formed in the nozzle plate 84. Also, an ink repelling treatment is applied to the outer surface of the nozzle plate 84.

In the fourth embodiment of the present invention, the nozzle-side openings of the piezoelectric bodies 70A to 70D are formed such that, when the four piezoelectric bodies 70A to 70D are stacked one upon the other and joined to each other, the nozzle-side openings of a certain piezoelectric body are deviated by ¼P in the arranging direction X of the nozzle-side openings from the nozzle-side openings of the adjacent piezoelectric body, as in the first embodiment of the present invention. It follows that the ink jet head according to the fourth embodiment of the present invention has a nozzle density four times as high as that of the ink jet head formed of a single piezoelectric body, e.g., the piezoelectric body 70A alone. In other words, the ink jet nozzle according to the fourth embodiment of the present invention has a nozzle density two times as high as that of the ink jet nozzle formed of two piezoelectric bodies. To be more specific, where each of the piezoelectric bodies 70A to 70D has a nozzle density of 90 dpi, the ink jet nozzle according to the fourth embodiment of the present invention has a nozzle density of 360 dpi (i.e., about 70.6 $\mu$m).

The ink jet head according to the fourth embodiment of the present invention, which is configured as described above, performs the function similar to that performed by the ink jet head according to the first embodiment of the present invention. However, the ink jet head according to the fourth embodiment differs from the ink jet head according to the first embodiment in that (1) the four piezoelectric bodies 70A to 70D are equal to each other in the outer shape size, (2) used is only one flexible substrate 78 provided with the driving circuit 80 connected to the electrodes of the four sets of grooves 72 of the piezoelectric bodies 70A to 70D, (3) the flexible substrate 78 is fixed to other end surfaces 70*c* of the piezoelectric bodies 70A to 70D, said other end surfaces 70*c* being positioned on the same plane, (4) the length of the conductive path between the electrode of the groove 72 and the driving circuit 80 for the fourth embodiment is shorter than that for the first embodiment, and (5) the lengths of the conductive paths between the groove 72 and the driving circuit 80 formed in the different piezoelectric bodies differ from each other. However, the difference is small.

Because of the particular construction described above, the ink jet nozzle according to the fourth embodiment of the present invention has of course a high nozzle density. In addition, since the four piezoelectric bodies have the same outer shape sizes, the manufacturing cost can be reduced. Further, the ink jet head can be miniaturized and can be made lightweight. Also, only one flexible substrate is used in the ink jet head according to the fourth embodiment of the present invention so as to facilitate the arrangement of the flexible substrate and to make the construction compact. Further, the ink jet head according to the fourth embodiment of the present invention permits exhibiting desired ink ejecting characteristics so as to obtain a printed image of a higher quality.

Also, in the ink jet head according to the fourth embodiment of the present invention, it is possible to supply a sufficiently large amount of an ink by simply fixing the liquid supply small container 82 of the common liquid supply section to all the other end surfaces of the four piezoelectric bodies 70A to 70D. As a result, the construction of the liquid supply section can be made simple so as to avoid a complex construction. It is also possible to reduce the manufacturing cost of the ink jet head according to the fourth embodiment of the present invention. Incidentally, the outer shape size of the ink jet head can be made compact and the ink jet head can be made lightweight in the fourth embodiment of the present invention as in the first to third embodiments and the modifications thereof.

In addition, in the ink jet head according to the fourth embodiment of the present invention, the lateral cross sectional area of each of the liquid supply openings 78*a* is set smaller than the lateral cross sectional area of the opening of the other end 72*b* of the corresponding groove 72. It follows that, even where a driving voltage is impressed to the electrode within the corresponding groove 72 so as to vibrate the side wall of the corresponding groove 72 and, thus, to generate an acoustic wave, it is possible to lower the rate of release of the acoustic wave to the outside through the opening of the other end 72*b* of the corresponding groove 72. As a result, it is possible to prevent the pressure of the ink ejected to the outside through the nozzle 84*a* from being lowered so as to lower the power required for ejecting the ink droplets.

It should also be noted that the acoustic wave generated when ink is ejected from a certain groove 72 is likely to give an adverse effect to the neighboring grooves 72. In the ink jet head according to the fourth embodiment of the present invention, however, the liquid supply opening 78*a* is made sufficiently small so as to suppress the propagation of the vibration of the acoustic wave to the neighboring grooves.

Further, in the fourth embodiment of the present invention, the ink reservoir of the liquid supply small container 82 is divided into a plurality of small sections 82*a* to 82*d*. The flexible ink supply pipe extending from an ink tank is connected to each of the connection plugs 82*e*. Where a plurality of ink tanks are connected to the plural connection plugs 82*e*, it is possible to store the inks of different colors in the different ink tanks. It is also possible to store the ink of the same color in the ink tanks. It is also possible to store different kinds of inks (not shown), the number of kinds being smaller than the number of ink tanks, in a plurality of ink tanks (not shown) in a classified manner.

The ink jet head according to the fourth embodiment of the present invention includes four small sections 82*a* to 82*d* and four connection plugs 82*e*, making it possible to use inks having the maximum of four colors of, for example, black, cyan, magenta and yellow. However, it is possible to set the number of these small sections, etc. at 2 or a desired number larger than 2.

As a result, the ink jet head according to the fourth embodiment of the second embodiment permits ejecting inks of a plurality of colors. Therefore, compared with the conventional case of using a plurality of ink jet heads for the inks of a plurality of colors, the ink jet head according to the fourth embodiment of the present invention, which performs the same function, is rendered compact and makes it unnecessary to carry out the aligning operation of the ink jet heads.

It should also be noted that, in the ink jet head according to the fourth embodiment of the present invention, the ink reservoir of the liquid supply small container 82 is partitioned into small sections. Therefore, the ink jet head according to the fourth embodiment of the present invention makes it possible to form a wide image per ink of a single color by allowing the nozzle plate 84 of the ink jet head to face a recording medium and by ejecting the ink while moving the ink jet head in the Y-direction. It follows that it is possible to increase the image forming rate using inks of a plurality of colors.

Further, in the fourth embodiment of the present invention, it is possible to construct the external connection conductive pattern 78*d* mounted to the single flexible plate 78 such that the external connection conductive pattern 78*d* is can be detachable to control circuit (not shown). In the case of this construction, the ink jet head according to the fourth embodiment of the present invention can be formed as a cartridge type ink jet head that can be detached mechanically and electrically from the ink jet printer by mounting a socket that can be electrically connected to the external connection conductive pattern.

(Modification of Fourth Embodiment)

A modification of the fourth embodiment of the present invention will now be described in detail with reference to FIG. 19.

Figure 19:
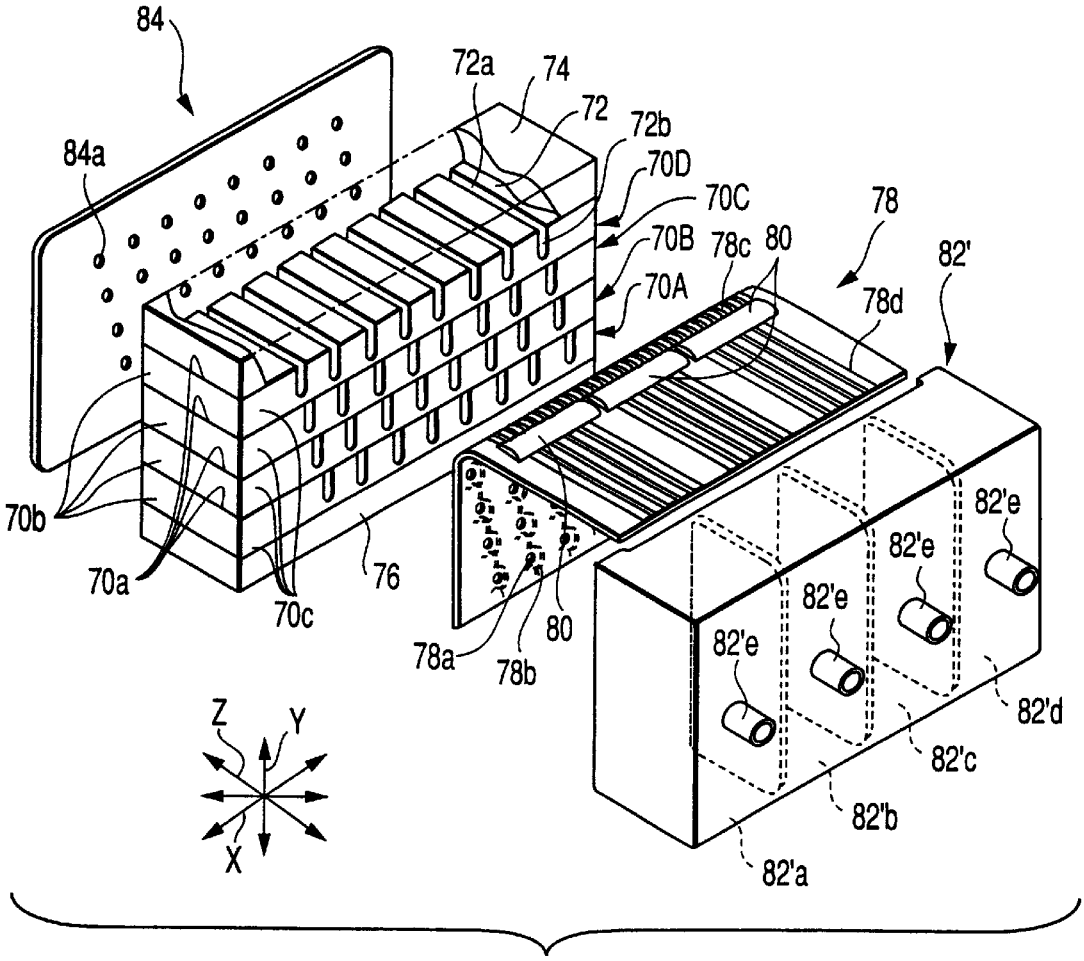
FIG. 19 is an exploded perspective view schematically showing an ink jet head according to a modification of the fourth embodiment of the present invention.

FIG. 19 is an exploded perspective view schematically showing the ink jet head according to a modification of the fourth embodiment of the present invention.

The modification of the fourth embodiment is equal to the fourth embodiment in the major portion of the constituting members of the ink jet head. The constituting members equal to those of the fourth embodiment are denoted by the same reference numerals in the following description so as to avoid an overlapping description.

The ink jet head according to the modification of the fourth embodiment differs from the ink jet head according to the fourth embodiment in that the ink reservoir of the liquid supply small container 82' is divided into a plurality of small sections 82'*a*, 82'*b*, 82'*c* and 82'*d* in different directions. In the ink jet head according to the modification of the fourth embodiment, the ink reservoir of the liquid supply small container 82' is divided into a plurality of small sections 82'*a*, 82'*b*, 82'*c* and 82'*d* in the arranging direction X of the plural grooves 72 of each of the piezoelectric bodies 70A to 70D, as shown in FIG. 19, as well as the openings on the side of the one end 72*a* of a plurality of grooves 72 of the piezoelectric bodies 70A to 70D.

In the ink jet head according to the modification of the fourth embodiment, different inks are supplied to the divided sections of the ink reservoir of the liquid supply small container 82', and the inks are ejected by moving the nozzle plate 84 of the ink jet head in the X-direction while allowing the nozzle plate 84 to face a recording medium. In this case, the image forming region per ink of a single color for the ink jet head according to the modification of the fourth embodiment is smaller than that for the fourth embodiment of the present invention, but is capable of forming an image of a high density.

Incidentally, in the various embodiments and the modifications thereof described above, the number of the stacked piezoelectric bodies is not limited to four. It is theoretically possible to stack innumerable piezoelectric bodies one upon the other. Also, in each of the ink jet heads according to the various embodiments and modifications thereof described above, the nozzle-side openings of a certain piezoelectric body are deviated by ¼P in the X-direction relative to the nozzle-side openings of the adjacent piezoelectric body. However, the ink jet head according to the present invention is not limited to the particular construction. For example, it is possible for the openings of the different piezoelectric bodies to be aligned in the arranging direction X. In this case, it is possible to further increase the image density per ink of a single color by ejecting the ink while moving the nozzle plate of the ink jet head in the Y-direction with the nozzle plate allowed to face a recording medium.

As described above in detail, the apparatus for ejecting liquid droplets of the present invention can be summarized as follows.

1. A apparatus for ejecting liquid droplets, comprising a plate-like piezoelectric body having a pair of a primary surfaces, a pair of end surfaces, and electrodes, one primary surface on which a plurality of parallel grooves are formed a predetermined distance apart from each other and arranged in a predetermined arranging direction, one end surface differing from the one primary surface, each of the grooves having a pair of ends, one ends of said plural parallel grooves being open on said end surface and a plurality of nozzles being arranged to conform with said opening, and an electrode formed on the inner surface of each of said grooves;

wherein a liquid is supplied into said plural grooves and voltage is impressed to said electrode, thereby deforming the lateral cross section of the groove corresponding to the electrode to which the voltage has been impressed so as to permit the liquid within the groove to be ejected from the groove having the deformed lateral cross section through said nozzle;

characterized in that used are a plurality of said piezoelectric bodies that are stacked such that the one primary surfaces of said piezoelectric bodies are stacked one upon the other under the state that said plural nozzles on the one end surfaces are allowed to face the same direction and that the one primary surfaces of the piezoelectric bodies are allowed to face the same direction; and that a liquid supply path common to said plural grooves of each of said piezoelectric bodies is formed in said plural piezoelectric bodies.

The particular construction makes it possible to manufacture easily a liquid ejecting apparatus equipped with a large number of nozzles arranged at a high density with a low manufacturing cost.

2. The apparatus for ejecting liquid droplets according to item 1 above, wherein said liquid supply path is formed to extend through said plural piezoelectric bodies that are stacked one upon the other in the staking direction of said plural piezoelectric bodies.

The particular construction makes it possible to make said plural piezoelectric bodies equal to each other in construction, with the result that the apparatus for ejecting liquid droplets of the present invention can be manufactured with a low manufacturing cost.

3. The apparatus for ejecting liquid droplets according to item 2 above, wherein said liquid supply path is formed in the same position of each of said plural piezoelectric bodies.

The particular construction makes it possible to make the plural piezoelectric bodies equal to each other in construction and size, with the result that the apparatus for ejecting liquid droplets of the present invention can be manufactured with a low manufacturing cost.

4. The apparatus according to 2, wherein the liquid supply path is formed in a position a predetermined distance apart from the nozzle in the extending direction of the plural grooves formed in each of the stacked plural piezoelectric bodies.

The particular construction makes it possible to set constant the amount of the liquid droplets ejected from each of said nozzles of said plural grooves when a predetermined voltage is impressed to the electrode of each of said plural grooves.

5. The apparatus according to 1, wherein a plurality of piezoelectric bodies includes two piezoelectric bodies stacked each other, a plurality of nozzles formed in one piezoelectric body are deviated in a predetermined arranging direction from a plurality of nozzles formed in the other piezoelectric body.

The particular construction makes it possible to increase the density of a plurality of liquid droplets ejected from the apparatus for ejecting liquid droplets of the present invention.

6. The apparatus according to 1, wherein a plurality of piezoelectric body includes two piezoelectric bodies stacked each other, a plurality of nozzles formed in one piezoelectric body are arranged coincident in a predetermined arranging direction with a plurality of nozzles formed in the other piezoelectric body.

The particular construction makes it possible to allow a plurality of ejected liquid droplets to land on the same region of a recording medium in an overlapping manner so as to increase the diameter of the liquid droplet landed on the same region, thereby obtaining an image of a high density, in the case where the apparatus for ejecting liquid droplets of the present invention ejects liquid droplets while moving along said primary surface of each of the plural piezoelectric bodies in a direction perpendicular to said predetermined arranging direction.

7. The apparatus according to 4, further comprising a liquid supply section that supplies a liquid from outside the plural piezoelectric bodies into the liquid supply path, the liquid supply section being fixed to the outermost piezoelectric body among the stacked piezoelectric bodies.

The particular construction makes it possible supply a liquid to the liquid supply path common to the plural piezoelectric bodies by using a single liquid supply pipe so as to miniaturize the outer shape size of the apparatus for ejecting liquid droplets of the present invention and to lower the manufacturing cost of the apparatus for ejecting liquid droplets.

8. The apparatus according to 7, wherein the liquid supply path includes an inlet port that supplies the liquid into the liquid supply path, the inlet port is arranged in the outermost piezoelectric body, and the liquid supply section is connected to the inlet port.

The particular construction permits making shortest the liquid supply path between the liquid supply pipe and the plural grooves of each of the plural piezoelectric bodies so as to suppress the possibility that the bubbles generated in the liquid within the supply path obstruct the supply of the liquid.

9. The apparatus for ejecting liquid droplets according to 1 above, further comprises an external power supply line electrically connected to the electrode mounted in each of the plural grooves of said plural piezoelectric bodies, and a driving circuit mounted to said external power supply line so as to control the electric signal supplied to the electrode formed in each of the plural grooves, wherein said driving circuit is apart from the electrode within each of the plural grooves by the same distance.

The particular construction permits the impedance between the driving circuit and the electrode formed in the corresponding plural grooves to be substantially the same so as to permit said driving circuit to drive with a high stability said plural grooves of said plural piezoelectric bodies under the same conditions.

10. The apparatus for ejecting liquid droplets according to 9 above, wherein the corresponding driving circuit is fixed to said one primary surface of each of the plural piezoelectric bodies, and a recess housing said driving circuit is formed on the other primary surface opposite to said one primary surface of the adjacent piezoelectric body included in said plural piezoelectric bodies.

The particular construction makes it possible to arrange the driving circuit corresponding to each of said plural piezoelectric bodies in a region as close as possible to the corresponding piezoelectric body, thereby markedly lowering the possibility for the noise to be mixed in the electric signal transmitted from said driving circuit to the electrodes of the plural grooves of the corresponding piezoelectric body.

11. The apparatus according to 10, wherein a heat dissipating plate is formed between adjacent piezoelectric bodies stacked one upon the other, the plate that releases the heat generated from the driving circuit to the outside.

The driving circuit generates heat. Where the apparatus for ejecting liquid droplets is constructed as defined in 10 above, it is possible for the temperature of the driving circuit within said recess to be undesirably elevated. In such a case, it is possible to prevent the temperature of the driving circuit from being elevated to a level undesirable for the operation of the driving circuit by arranging the heat dissipating plate as defined in 11 above.

12. The apparatus according to claim 1, wherein the stacked piezoelectric bodies differ from each other in the area of the primary surface such that a region of the primary surface which is remote from the end surface is exposed to the outside, and a conductive pattern electrically connected to the electrode within the groove is mounted to the exposed region of the primary surface.

The particular construction makes it possible to set easily the construction for supplying an electric power to the electrode formed in each of the plural grooves formed in the stacked plural piezoelectric bodies.

13. The apparatus for ejecting liquid droplets according to 1 above, wherein said plural piezoelectric bodies are equal to each other in the outer shape.

The particular construction permits lowering the manufacturing cost of the plural piezoelectric bodies.

14. The apparatus for ejecting liquid droplets according to 1 above, the conductive means connected to the electrode formed in each of the plural grooves in each of the plural piezoelectric bodies extends to reach the other end surface opposite to the one end surface on which said nozzle is arranged in each of said plural piezoelectric bodies.

The particular construction makes it possible to render compact the construction required for connecting the conductive means to the external power supply line.

15. A apparatus for ejecting liquid droplets, comprising a plate-like piezoelectric body having a primary surface on which a plurality of parallel grooves are formed a predetermined distance apart from each other and arranged in a predetermined arranging direction, a end surface differing from said primary surface, one ends of said plural parallel grooves being open on said end surface and a plurality of nozzles being arranged to conform with said opening, and an electrode formed on the inner surface of each of said grooves;

wherein a liquid is supplied into said plural grooves and voltage is impressed to said electrode, thereby deforming the lateral cross section of the groove corresponding to the electrode to which the voltage has been impressed so as to permit the liquid within the groove to be ejected from the groove having the deformed lateral cross section through said nozzle;

characterized in that used are a plurality of said piezoelectric bodies that are stacked such that the primary surfaces of said piezoelectric bodies are stacked one upon the other under the state that said plural nozzles on said end surfaces are allowed to face the same direction and that said primary surfaces of the piezoelectric bodies are allowed to face the same direction; and that a liquid supply path for supplying a liquid to said plural grooves of each of said plural piezoelectric bodies and a conductive means electrically connected to the plural electrodes formed within said plural grooves are allowed to extend to reach the other end surface opposite to said end surface in which said nozzle is arranged in each of said plural piezoelectric bodies.

The particular construction makes it possible to manufacture easily and with a low manufacturing cost a apparatus for ejecting liquid droplets equipped with a large number of nozzles arranged at a high density.

16. The apparatus for ejecting liquid droplets according to item 15 above, characterized in that a substrate provided with a plurality of electrical contacts capable of an electrical connection to the extending ends of said conductive means of said plural electrodes formed in said plural grooves of said plural piezoelectric bodies and a plurality of liquid supply openings formed to correspond to the extending end of said liquid supply path of said plural grooves of said plural piezoelectric bodies is mounted to the other end surfaces of said plural piezoelectric bodies.

The particular construction makes it possible to provide the structure required for connecting said conductive means to the external power supply line and the structure required for connecting said plural liquid supply openings to the external liquid supply line.

17. The apparatus for ejecting liquid droplets according to 16 above, characterized in that the apparatus for ejecting liquid droplets further comprises a liquid supply pipe for supplying a liquid to said plural liquid supply paths of said plural piezoelectric bodies from the outside of said plural piezoelectric bodies, and said liquid supply pipe is fixed to the other end surfaces of said plural piezoelectric bodies.

The particular construction makes it possible to supply a liquid to said plural liquid supply paths of said plural piezoelectric bodies by using a single liquid supply pipe so as to miniaturize the outer shape size of the apparatus for ejecting liquid droplets of the present invention and to lower the manufacturing cost of the apparatus for ejecting liquid droplets.

18. The apparatus for ejecting liquid droplets according to 16 above, said substrate includes a flexible substrate.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

19. The apparatus according to 2, wherein the stacked piezoelectric bodies comprises a lowest piezoelectric body and at least one piezoelectric body other than the lowest one, said at least one piezoelectric body has at least one liquid flow path element, the lowest piezoelectric body has at least one liquid flow path element when the lowest piezoelectric body has a closing member, and the liquid flow path element forms liquid supply path.

What is claimed is:

1. An apparatus for ejecting liquid droplets, comprising:

a plurality of plate-like piezoelectric bodies, each of the piezoelectric bodies including a pair of primary surfaces, a pair of end surfaces, and electrodes, a plurality of grooves being formed on one of the primary surfaces, the grooves being arranged in parallel at a predetermined distance from each other, each of the grooves having a pair of ends, one of the end surfaces differing from the primary surface, one end of each of the parallel grooves being open in the one end surface, a plurality of nozzles being arranged to conform with the plural openings, the electrode formed on an inner surface of each of the grooves, the primary surfaces of the plural piezoelectric bodies facing the same direction, and the primary surfaces on which the nozzles are formed being stacked and mutually oriented in a common direction; and a liquid supply path that commonly supplies a liquid to all of the plural grooves formed on the respective plural piezoelectric bodies, the liquid supply path being common to the plural piezoelectric bodies;

such that the grooves are supplied with liquid, and a cross section of the grooves is changed to eject the liquid through the nozzles when a voltage is impressed to the electrodes.

2. The apparatus according to claim 1, wherein the liquid supply path extends through the plural piezoelectric bodies that are stacked one upon the other in the stacking direction of the plural piezoelectric bodies.

3. The apparatus according to claim 2, wherein the stacked piezoelectric bodies include a lowest piezoelectric body and at least one piezoelectric body other than the lowest piezoelectric body, at least the one piezoelectric body has at least one liquid flow path element that communicates with the grooves in one of the piezoelectric bodies that adjoin at least the one piezoelectric body, and at least the one liquid flow path element forms the liquid supply path.

4. The apparatus according to claim 2, wherein the liquid supply path is formed at a predetermined distance from the nozzle in the extending direction of the plural grooves formed in each of the stacked plural piezoelectric bodies.

5. The apparatus according to claim 4, further comprising a liquid supply section that supplies a liquid from outside the plural piezoelectric bodies into the liquid supply path, the liquid supply section being fixed to the outermost piezoelectric body among the stacked piezoelectric bodies.

6. The apparatus according to claim 5, wherein the liquid supply path includes an inlet port that supplies the liquid into the liquid supply path, the inlet port being arranged in the outermost piezoelectric body, and the liquid supply section being connected to the inlet port.

7. The apparatus according to claim 1, wherein the plurality of stacked piezoelectric bodies include at least one pair of piezoelectric bodies adjacent to each other in a stacking direction, and a plurality of nozzles formed in one of the pair of piezoelectric bodies are deviated in a predetermined arranging direction from a plurality of nozzles formed in the other piezoelectric body.

8. The apparatus according to claim 1, wherein the plurality of stacked piezoelectric bodies includes at least one pair of piezoelectric bodies adjacent to each other, a plurality of nozzles formed in one of the pair of piezoelectric bodies are arranged coincident in a predetermined arranging direction with a plurality of nozzles formed in the other piezoelectric body.

9. The apparatus according to claim 1, further comprising a conductive pattern electrically connected to the electrode formed in each of the grooves, and driving circuits that control driving signals supplied to the electrodes formed in the grooves, the driving circuits being set at substantially the same distances to the electrodes formed in the corresponding plural grooves.

10. The apparatus according to claim 9, wherein a heat dissipating plate is formed between adjacent piezoelectric bodies stacked one upon the other, the heat dissipating plate releasing the heat generated from the driving circuit to the outside.

11. The apparatus according to claim 9, wherein the driving circuit is fixed to the primary surface of each of the piezoelectric bodies, and a recess capable of housing the driving circuit is formed on the back surface opposite to the primary surface of the adjacent piezoelectric body.

12. The apparatus according to claim 11, wherein a heat dissipating plate is arranged in the recess, the plate serving to assist the release of the heat generated from the driving circuit to the outside.

13. The apparatus according to claim 11, wherein the heat dissipating plate is mounted directly to the driving circuit.

14. The apparatus according to claim 1, wherein the stacked piezoelectric bodies differ from each other in the area of the primary surface such that a region of the primary surface which is remote from the end surface is exposed to the outside, and a conductive pattern electrically connected to the electrode within the groove is mounted to the exposed region of the primary surface.

15. The apparatus according to claim 1, wherein the stacked piezoelectric bodies are equal to each other in the outer shape.

16. The apparatus according to claim 15, wherein each of the piezoelectric bodies comprises the conductive pattern connected to the electrode of the groove and each of the conductive patterns extends to the other end surface opposite to the one end surface in each of the piezoelectric bodies.

17. The apparatus according to claim 15, further comprising a flexible substrate including a plurality of driving circuits that control driving signals to be supplied to the respective electrodes, wherein the flexible substrate is fixed and is electrically connectable to the plurality of conductive patterns formed on the other end surface of each of the piezoelectric bodies.

18. An apparatus for ejecting liquid droplets, comprising:

a plurality of plate-like piezoelectric bodies, each of the piezoelectric bodies including a pair of a primary surfaces, a pair of end surfaces, and electrodes, one primary surface on which a plurality of grooves are formed, the grooves being arranged in parallel a predetermined distance apart from each other, each of the grooves having a pair of ends, the one end surface differing from the primary surface, one end of each of the parallel grooves being open in the one end surface, a plurality of nozzles being arranged to conform with the plural openings in the one end surface, the other end surface differing from the primary surface, the other end of each of the parallel grooves being open in the other end surface, a plurality of ink supply ports being arranged to conform with the plural openings In the other end surface, the electrode being formed on the inner surface of each of the grooves in a manner to extend to reach the other end surface, the primary surfaces of the plural piezoelectric bodies facing the same direction, and the primary surfaces on which the nozzles are formed being stacked and mutually oriented in a common direction;

a liquid supply path that continuously supplies a liquid to the plural grooves being formed on the respective plural piezoelectric bodies, the liquid supply path being common to the plural piezoelectric bodies; and a substrate having a plurality of electrical contacts that can be electrically connected to the electrodes, and holes for a plurality of liquid flow paths, each of the holes supplying liquid to each groove, the substrate being arranged on the other end surface of said piezoelectric body;

such that the common liquid supply path and the substrate are fixed to the other end surface of said piezoelectric body, the grooves being supplied with liquid, and a cross section of the grooves being changed to eject the liquid through the nozzles when a voltage is impressed to the electrodes.

19. The apparatus according to claim 18, wherein a liquid supply section is mounted to the other end surfaces of the plural piezoelectric bodies with the substrate interposed therebetween, the liquid supply section that ejects liquid from outside the piezoelectric body into the plural grooves of each piezoelectric body.

20. The apparatus according to claim 18, wherein the plurality of stacked piezoelectric bodies include at least one pair of piezoelectric bodies adjacent to each other in the stacking direction, a plurality of nozzles formed in one of the pair of piezoelectric bodies being deviated in a predetermined arranging direction of the grooves, from a plurality of nozzles formed in the other piezoelectric body.

21. An apparatus for ejecting ink, comprising a plurality of ink jet units and at least one liquid supply path, each of the ink jet units including ink supply portions, ink ejecting sections, and ink chambers, each of the ink supply portions supplying ink to each of the ink chambers, each of the ink ejecting sections ejecting ink, each of the ink chambers being arranged between the ink supply portion and the ink jet section and storing the ink supplied from the ink supply portion, each of the ink chambers applying ejecting energy to the ink therein, the plural ink jet units being stacked one upon the other such that the ink ejecting sections face in the same direction, and the liquid supply path being commonly formed over the plural ink jet units so as to supply ink to each ink chamber of the plural ink jet units.

* * * * *